US009989906B2

(12) United States Patent
Yoshie et al.

(10) Patent No.: US 9,989,906 B2
(45) Date of Patent: Jun. 5, 2018

(54) FIXING DEVICE, IMAGE FORMING APPARATUS, AND METHOD OF CONTROLLING IMAGE FORMING APPARATUS

(71) Applicant: Konica Minolta, Inc., Tokyo (JP)

(72) Inventors: Naoki Yoshie, Ibaraki (JP); Chiaki Yamada, Ibaraki (JP); Toru Kikuchi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/427,620

(22) Filed: Feb. 8, 2017

(65) Prior Publication Data

US 2017/0235261 A1 Aug. 17, 2017

(30) Foreign Application Priority Data

Feb. 16, 2016 (JP) ..... 2016-026795

(51) Int. Cl.
*G03G 15/20* (2006.01)

(52) U.S. Cl.
CPC . *G03G 15/2064* (2013.01); *G03G 2215/0132* (2013.01); *G03G 2215/2032* (2013.01)

(58) Field of Classification Search
CPC ..... G03G 15/2064
See application file for complete search history.

(56) References Cited

U.S. PATENT DOCUMENTS

2005/0191071 A1* 9/2005 Katayanagi ..... G03G 15/206 399/45
2013/0121716 A1* 5/2013 Okuno ..... G03G 15/2053 399/67
2014/0086608 A1* 3/2014 Murakami ..... G03G 15/2085 399/67

FOREIGN PATENT DOCUMENTS

JP 2003337498 A 11/2003
JP 2010217232 A 9/2010

* cited by examiner

*Primary Examiner* — Clayton E Laballe
*Assistant Examiner* — Jas Sanghera
(74) *Attorney, Agent, or Firm* — Lucas & Mercanti, LLP

(57) ABSTRACT

A control unit is configured to control torque of a fixing motor and torque of a pressing motor such that tangential force at a part holding paper in cooperation with a fixing member in a pressing member is equal to or greater than tangential force at a part holding paper in cooperation with the pressing member in the fixing member, and that the relation between the tangential force at the part of the pressing member and the tangential force at the part of the fixing member changes in accordance with the smoothness of paper.

16 Claims, 9 Drawing Sheets

$$T1=F1 \cdot R1 \quad \cdots (1)$$
$$T2=F2 \cdot R2 \quad \cdots (2)$$

$$F1 \leq F2 \quad \cdots (3)$$

$$T1/R1 \leq T2/R2 \quad \cdots (4)$$

FIG.8

| | PAPER TYPE | TORQUE T1 : T2 | T2 RELATIVE RATIO | BELT HARDNESS | TONER G'(60) | NIP LENGTH | IMAGE DISORDER | SEPARATION | FIXING STRENGTH |
|---|---|---|---|---|---|---|---|---|---|
| EXAMPLE 1 | OK TOPCOAT | 5 : 95 | 1 | BELT 1 85° | TONER(1) $5\times10^{7}$ | 18mm | A | B | B |
| EXAMPLE 2 | OK TOPCOAT | 25 : 75 | 0.79 | BELT 1 85° | TONER(1) $5\times10^{7}$ | 18mm | A | C | B |
| EXAMPLE 3 | LEZAK 66 151g | 5 : 95 | 1 | BELT 1 85° | TONER(1) $5\times10^{7}$ | 18mm | C | B | B |
| EXAMPLE 4 | LEZAK 66 151g | 13 : 87 | 0.92 | BELT 1 85° | TONER(1) $5\times10^{7}$ | 18mm | B | B | B |
| EXAMPLE 5 | LEZAK 66 151g | 14 : 86 | 0.9 | BELT 1 85° | TONER(1) $5\times10^{7}$ | 18mm | A | B | B |
| EXAMPLE 6 | LEZAK 66 151g | 25 : 75 | 0.79 | BELT 1 85° | TONER(1) $5\times10^{7}$ | 18mm | A | B | B |
| EXAMPLE 7 | LEZAK 66 151g | 25 : 75 | 0.79 | BELT 2 80° | TONER(1) $5\times10^{7}$ | 18mm | A | B | B |
| EXAMPLE 8 | LEZAK 66 151g | 25 : 75 | 0.79 | BELT 3 95° | TONER(1) $5\times10^{7}$ | 18mm | A | B | B |
| EXAMPLE 9 | LEZAK 66 151g | 25 : 75 | 0.79 | BELT 5 79° | TONER(1) $5\times10^{7}$ | 18mm | B | B | B |
| EXAMPLE 10 | LEZAK 66 151g | 25 : 75 | 0.79 | BELT 4 96° | TONER(1) $5\times10^{7}$ | 18mm | A | B | C |
| EXAMPLE 11 | LEZAK 66 151g | 25 : 75 | 0.79 | BELT 1 85° | TONER(2) $1.2\times10^{8}$ | 18mm | C | B | C |
| EXAMPLE 12 | LEZAK 66 203g | 49 : 51 | 0.55 | BELT 1 85° | TONER(1) $5\times10^{7}$ | 24mm | A | B | B |

FIXING DEVICE, IMAGE FORMING APPARATUS, AND METHOD OF CONTROLLING IMAGE FORMING APPARATUS

This application is based on Japanese Patent Application No. 2016-026795 filed with the Japan Patent Office on Feb. 16, 2016, the entire content of which is hereby incorporated by reference.

BACKGROUND OF THE INVENTION

Field of the Invention

The present disclosure relates to a fixing device, an image forming apparatus, and a method of controlling an image forming apparatus, and more specifically relates to a fixing device including a heating roller and a pressing roller, an image forming apparatus having such a fixing device, and a method of controlling the same.

Description of the Related Art

Conventionally, an image forming apparatus such as an MFP (Multi-Functional Peripheral) includes a fixing device for fixing an image formed with toner or the like on paper. As an example, the fixing device has a heating roller and a pressing roller rotating independently of each other. For example, Japanese Laid-Open Patent Publication No. 2003-337498 discloses a technique for controlling the difference in speed between the heating roller and the pressing roller based on image density information. Japanese Laid-Open Patent Publication No. 2010-217232 discloses a technique in an image forming apparatus including a fixing roller as a heating roller, in which when the peripheral speed of the pressing roller exceeds the peripheral speed of the fixing roller, a clutch disconnects the fixing roller from the motor thereby to allow the fixing roller to rotate in connection with the pressing roller.

In conventional fixing devices, when an image formed on paper having a rough surface (for example, embossed paper) is fixed, image disorder may occur. FIG. 9 is a diagram for explaining one of factors causing image disorder on paper having a rough surface. In FIG. 9, State 1 shows a state in which paper is located at a nip portion. State 2 shows a state in which paper is discharged from the nip portion.

In State 1 in FIG. 9, toner forming an image on paper 900 is illustrated by hatching. FIG. 9 further illustrates a belt 901 for fixing an image on paper 900. Arrow DX indicates the direction in which belt 901 moves relative to paper 900. Arrow DY indicates the conveyance direction of paper 900.

FIG. 9 shows paper 900 in an enlarged view. Paper 900 is illustrated as embossed paper and has a depressed portion D.

In State 1, a region with toner on paper 900 is divided into three regions (region A to region C), based on a state of toner. In FIG. 9, toner is illustrated by hatching which is different for each region of toner.

In region A, as depicted as toner TA, the degree at which toner abuts on belt 901 is high. In region A, therefore, toner is fused.

Region B is located at the edge of depressed portion D. In region B, as depicted as toner TB, the degree at which toner abuts on belt 901 is low compared with region A. In region B, therefore, toner is in a half-fused state.

Region C is located at the center of depressed portion D. In region C, as depicted as toner TC, the degree at which toner abuts on belt 901 is further lower than in region B. In region C, therefore, toner is almost granular.

In State 1, region B is located at the boundary between depressed portion D and the other portion. The surface at region B of paper 900 has a slope in the direction along arrow DX. Because of this, when paper 900 is discharged from the nip portion, belt 901 moves relative to paper 900 to exert force (shear force) on region B in the moving direction of belt 901. This removes toner TX from paper 900 as shown in State 2 in FIG. 9. The image formed on paper 900 is then disordered. The shear force refers to force produced between paper 900 and belt 901. The shear force is caused by the difference between the driving force of the roller on the front surface-side of paper 900 (the surface side with toner in FIG. 9) and the driving force of the roller on the back surface-side of paper 900 (the surface different from the surface with toner in FIG. 9), and/or deformation of belt 901.

Meanwhile, an adequate shear force is advantageous in removing toner from belt 901.

SUMMARY OF THE INVENTION

Based on the forgoing, in the fixing device, it is requested to reduce disorder of an image formed on paper, irrespective of the degree of surface roughness (smoothness) of paper. The present disclosure is conceived in view of the situations described above.

In accordance with an aspect of the present disclosure, a fixing device is provided, which includes a fixing member configured to abut on a surface of paper, the surface having an image formed thereon, a pressing member configured to hold paper in cooperation with the fixing member, a fixing motor configured to drive the fixing member in order to convey paper held between the fixing member and the pressing member, a pressing motor configured to drive the pressing member in order to convey paper held between the fixing member and the pressing member, and a control unit configured to control torques of the fixing motor and the pressing motor. The control unit is configured to acquire smoothness of paper held between the fixing member and the pressing member and control torques of the fixing motor and the pressing motor such that tangential force at a part holding paper in cooperation with the fixing member in the pressing member is equal to or greater than tangential force at a part holding paper in cooperation with the pressing member in the fixing member, and that a relation between tangential force at the part of the pressing member and tangential force at the part of the fixing member changes in accordance with the smoothness.

In an image forming apparatus according to the present disclosure, the control unit may be configured to control torques of the fixing motor and the pressing motor such that a difference between tangential force at the part of the pressing member and tangential force at the part of the fixing member increases as the smoothness increases.

The fixing device may further include a fixing roller and a heating roller configured to rotate the fixing member. The fixing member may include a belt stretched around the fixing roller and the heating roller.

A surface of the belt may have MD-1 hardness (type C) of not less than 80° and not more than 95°.

The control unit may be configured to control torques of the fixing motor and the pressing motor such that a ratio of tangential force at the part of the fixing member when the smoothness is less than a predetermined value to tangential force at the part of the fixing member when the smoothness is equal to or greater than a predetermined value is 0.9 or less.

The fixing device further includes a smoothness sensor configured to detect smoothness of paper. The control unit may be configured to acquire smoothness detected by the smoothness sensor.

The fixing device may further include a change unit configured to change a length of a part where the fixing member and the pressing member hold paper, in a paper conveyance direction. The control unit may be configured to control torques of the fixing motor and the pressing motor such that a difference between tangential force at the part of the pressing member and tangential force at the part of the fixing member decreases as the length of the part increases.

In an image forming apparatus according to the present disclosure, the fixing device may further include a fixing-side torque sensor configured to detect torque of the fixing motor and a pressing-side torque sensor configured to detect torque of the pressing motor. The control unit may be configured to perform feedback control of torques of the fixing motor and the pressing motor, based on detection outputs of the fixing-side torque sensor and the pressing-side torque sensor.

According to another aspect of the present disclosure, an image forming apparatus is provided, which includes an image forming unit configured to form an image on paper, and a fixing unit configured to fix an image formed by the image forming unit on the paper. The fixing unit includes a fixing member configured to abut on a surface of paper, the surface having an image formed thereon, a pressing member configured to hold paper in cooperation with the fixing member, a fixing motor configured to drive the fixing member in order to convey paper held between the fixing member and the pressing member, a pressing motor configured to drive the pressing member in order to convey paper held between the fixing member and the pressing member, and a control unit configured to control torques of the fixing motor and the pressing motor. The control unit is configured to acquire smoothness of paper held between the fixing member and the pressing member and control torques of the fixing motor and the pressing motor such that tangential force at a part holding paper in cooperation with the fixing member in the pressing member is equal to or greater than tangential force at a part holding paper in cooperation with the pressing member in the fixing member, and that a relation between tangential force at the part of the pressing member and tangential force at the part of the fixing member changes in accordance with the smoothness.

In accordance with a further aspect of the present disclosure, a method of controlling an image forming apparatus is provided. The method includes the steps of: forming an image on paper; acquiring smoothness of the paper; fixing the image on the paper by holding the paper between a fixing member and a pressing member; and controlling torque of a fixing motor configured to drive the fixing member and torque of a pressing motor configured to drive the pressing member in order to convey the paper held between the fixing member and the pressing member. The fixing member abuts on a surface of the paper, the surface having an image formed thereon. Tangential force at a part holding paper in cooperation with the fixing member in the pressing member is equal to or greater than tangential force at a part holding paper in cooperation with the pressing member in the fixing member. The relation between tangential force at the part of the pressing member and tangential force at the part of the fixing member changes in accordance with the smoothness.

In the method of controlling an image forming apparatus according to the present disclosure, the step of forming an image includes forming an image using toner having an elastic modulus at 60° C. of $1\times10^8$ Pa or less.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 8 is a diagram showing the results of image formation under various conditions in the MFP.

DESCRIPTION OF THE PREFERRED EMBODIMENTS

Embodiments of an image forming apparatus will be described below with reference to the drawings. In the following description, the same parts and components are denoted with the same reference signs. Their designations and functions are also the same and a description thereof will not be repeated.

[1] OVERALL CONFIGURATION OF IMAGE FORMING APPARATUS

Figure 1:
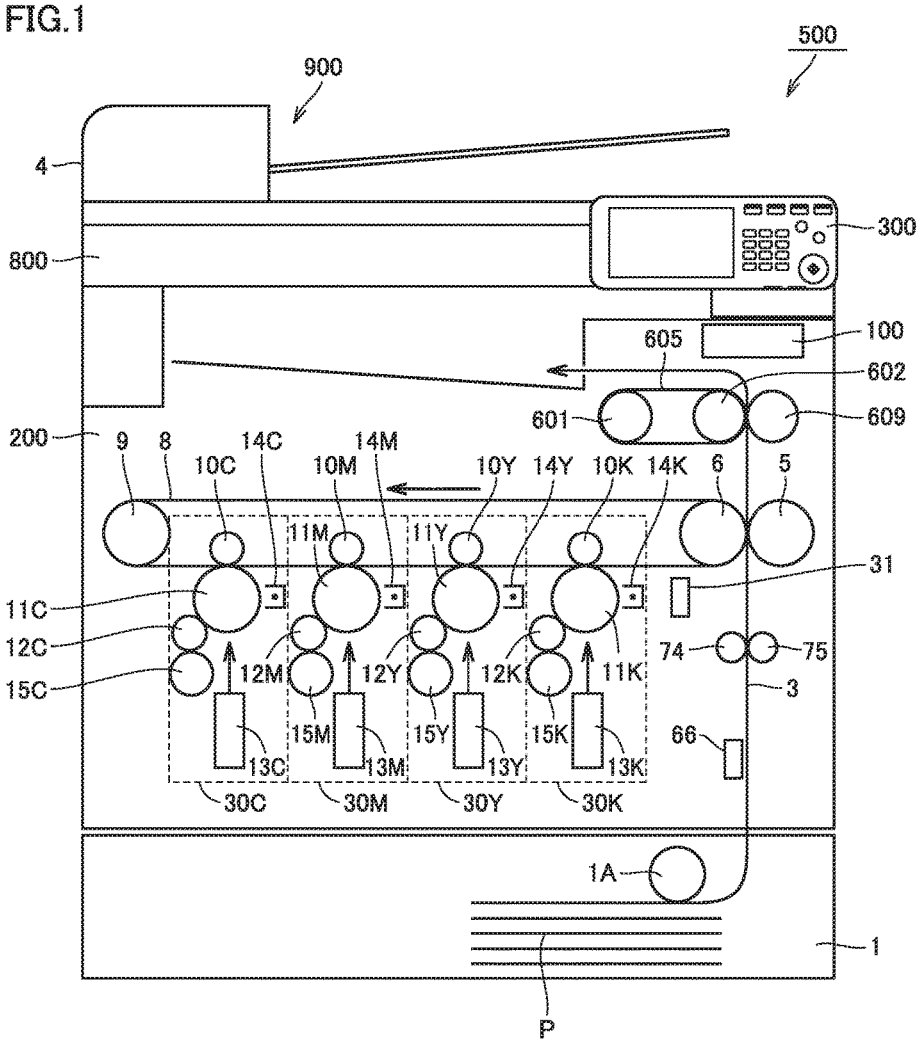
FIG. 1 is a diagram schematically showing a configuration of an MFP as an exemplary image forming apparatus.

FIG. 1 is a diagram schematically showing a configuration of MFP 500 as an exemplary image forming apparatus. FIG. 1 illustrates an image forming apparatus having a tandem color image forming unit as an example of the image forming apparatus.

Referring to FIG. 1, MFP 500 includes a control unit 100 and an image forming unit 200. Image forming unit 200 typically forms a color or monochrome image on paper P loaded in a paper feeding unit 1, based on image information obtained by an image reading unit 800 optically reading the content of an original to be printed. Image reading unit 800 is coupled with an ADF (Auto Document Feeder) 900 so that an original to be printed is conveyed in order from ADF 900.

More specifically, image forming unit 200 includes process units 30C, 30M, 30Y, 30K (hereinafter collectively referred to as "process unit 30") for four colors including cyan (C), magenta (M), yellow (Y), and black (K), respectively. The process unit 30 of each color is arranged along the moving direction of a transfer belt 8 and successively forms a toner image of the corresponding color on transfer belt 8.

Process units 30C, 30M, 30Y, 30K include primary transfer rollers 10C, 10M, 10Y, 10K (hereinafter collectively referred to as "primary transfer roller 10"), photoconductors 11C, 11M, 11Y, 11K (hereinafter collectively referred to as "photoconductor 11"), development rollers 12C, 12M, 12Y, 12K (hereinafter collectively referred to as "development roller 12"), print heads 13C, 13M, 13Y, 13K (hereinafter collectively referred to as "print head 13"), electrostatic chargers 14C, 14M, 14Y, 14K (hereinafter collectively referred to as "electrostatic charger 14"), and toner units 15C, 15M, 15Y, 15K (hereinafter collectively referred to as "toner unit 15"), respectively.

When a print request in accordance with the user operation on an operation panel 300 or the like is received, each process unit 30 forms a toner image of each color for forming an image to be printed, on photoconductor 11, and transfers the formed toner image of each color onto transfer belt 8 in synchronization with the other process units 30. Here, primary transfer roller 10 moves the toner image on the corresponding photoconductor 11 to transfer belt 8.

In each process unit, electrostatic charger 14 charges the surface of the rotating photoconductor 11, and print head 13 exposes the surface of photoconductor 11 in accordance with image information to be printed. An electrostatic latent image representing a toner image to be formed is thus formed on the surface of photoconductor 11. Subsequently, development roller 12 supplies toner in toner unit 15 to the surface of photoconductor 11. The electrostatic latent image is then developed as a toner image on photoconductor 11. Subsequently, primary transfer roller 10 transfers the toner image developed on the surface of each photoconductor 11 in order onto transfer belt 8 rotated by a driving motor 9. The toner image of each color is then superimposed with another to form a toner image to be transferred onto paper P.

Image forming unit 200 includes a density sensor 31 for detecting the toner density on transfer belt 8 in order to stabilize the density of a toner image to be printed.

In image stabilization control using density sensor 31, several patches for detecting the toner density are formed on transfer belt 8 by printing with different toner densities with different development outputs from the development unit. Image forming unit 200 detects the toner density using density sensor 31 and provides feedback to the development output of the development unit in accordance with the result to obtain a toner density always stable during printing. The image stabilization control can be performed, for example, when the main switch of the apparatus body is turned on, when the toner cartridge is replaced, or when the print count reaches a predetermined number.

Image forming unit 200 further includes a paper cassette 1. In paper cassette 1, a paper feeding roller 1A picks up paper P loaded in paper cassette 1. The paper P picked up is conveyed by a conveyance roller 74 and the like along a conveyance path 3. Conveyance roller 74 keeps paper P waiting at a position where paper P reaches the timing sensor. Subsequently, conveyance roller 74 conveys paper P to secondary transfer roller 5 at the timing when the toner image formed on transfer belt 8 reaches secondary transfer roller 5.

Secondary transfer roller 5 and opposing roller 6 allow the toner image on transfer belt 8 to be transferred onto paper P. Typically, a predetermined potential (for example, about +2000 V) is applied to secondary transfer roller 5 in accordance with the charge of the toner image to produce a force for electrically pulling the toner image on transfer belt 8 toward secondary transfer roller 5, thereby transferring the toner image onto paper P.

The toner image formed on paper P is further processed by a fixing device (fixing unit 60 in FIG. 2 described later) including a fixing belt 605 and then fixed on paper P. Paper P having the toner image fixed thereon is output to a paper output tray. The print process is then finished.

In MFP 500, fixing belt 605 is an example of the fixing member, and pressing roller 609 is an example of the pressing member.

A smoothness sensor 66 is provided along conveyance path 3. Smoothness sensor 66 detects the smoothness of the surface of paper P on conveyance path 3 and outputs the detection result to control unit 100. MFP 500 can include a sensor of any type, such as the air leakage type, as smoothness sensor 66.

[2] CONFIGURATION OF FIXING DEVICE

Figure 2:
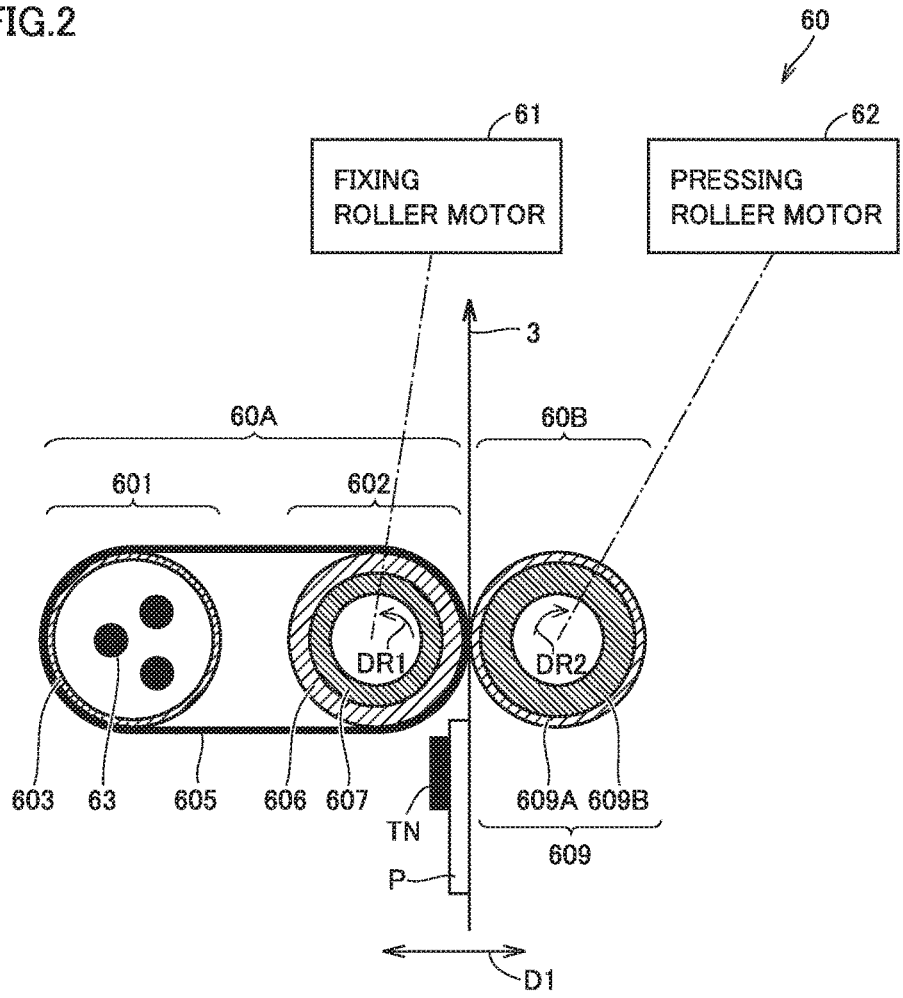
FIG. 2 is a diagram schematically showing a configuration of the fixing unit of the MFP in FIG. 1.

FIG. 2 is a diagram schematically showing a configuration of fixing unit 60 of MFP 500 in FIG. 1. As shown in FIG. 2, fixing unit 60 includes a heating unit 60A and a pressing unit 60B.

Heating unit 60A includes a heating roller 601 and a fixing roller 602. A fixing belt 605 is stretched around heating roller 601 and fixing roller 602.

A heater 63 is installed in the inside of heating roller 601. Heater 63 heats the surface of fixing belt 605. The heating temperature is, for example, 80 to 250° C. Fixing belt 605 is provided with a temperature sensor ("temperature sensor 64" in FIG. 2), not shown in FIG. 1, on its surface. In MFP 500, the temperature sensor monitors the temperature of fixing belt 605 and feeds this temperature back to a temperature control circuit abbreviated in the figures. Fixing belt 605 is thus controlled at a predetermined temperature.

Fixing roller 602 includes a metal cylindrical body coated with rubber 603. The rubber is heat-resistant. The material of rubber is, for example, silicone rubber or fluorocarbon rubber. The rubber hardness is about 5 degrees to 50 degrees. The thickness of rubber is, for example, about 1 mm to 50 mm. In order to improve the releasability of the rubber surface, the material that coats the cylindrical body of fixing roller 602 may be, for example, a fluorocarbon-based resin.

Fixing belt 605 is produced, for example, by coating a metal or resin body with a rubber layer and providing a release layer on the surface of the rubber layer. When the body is formed of resin, the resin may be a heat-resistant resin such as polyimide. The rubber layer may be formed of a heat-resistant silicone rubber or fluorocarbon rubber. The rubber layer has a thickness of, for example, about 0.1 mm to 5 mm. The rubber hardness is, for example, 5 degrees to 50 degrees. The release layer is formed of a fluorocarbon-based resin such as PFA (perfluoroalkoxy alkane) or PTFA (polytetrafluoroethylene).

The MD-1 hardness (type C) of fixing belt 605 may be not less than 85° and not more than 95°. If the MD-1 hardness is less than 85°, the contact area on the boundary surface between the protruding and depressed portions is large, and the possibility that image disorder occurs is high. In addition, if less than 85°, the durability of fixing belt 605 may be poor. If the MD-1 hardness exceeds 95°, the contact surface on the protruding portion is small, and the fixing strength may be poor.

Pressing unit 60B is mainly configured with a pressing roller 609. Pressing roller 609 includes a metal cylindrical body 609A coated with rubber 609B. Rubber 609B is, for example, heat-resistant rubber such as silicone-based or fluorocarbon-based rubber. Rubber 609B has a thickness of, for example, about 0.1 mm to 20 mm. The hardness of rubber 609B is, for example, about 5 degrees to 50 degrees. The rubber 609B may be provided with a release layer on its surface.

In order to quickly heat pressing unit 60B, a heat source (heater) may be provided in the inside of pressing roller 609.

Fixing unit 60 includes a fixing roller motor 61 and a pressing roller motor 62. Fixing roller motor 61 drives the rotation of fixing roller 602. For example, a servo motor is installed as fixing roller motor 61. Arrow DR1 indicates the direction in which fixing roller 602 rotates.

Pressing roller motor 62 drives the rotation of pressing roller 609. For example, a pulse motor is installed as pressing roller motor 62. Arrow DR2 indicates the direction in which pressing roller 609 rotates.

Fixing belt 605 abuts on pressing roller 609. The portion where fixing belt 605 abuts on pressing roller 609 forms a part of conveyance path 3 of paper P. In this portion, the toner image formed on paper P is fixed. In the present description, the portion where fixing belt 605 abuts on pressing roller 609 is also called "nip portion". In MFP 500, the load applied to paper at the nip portion is, for example, about 1500 N to 5000 N.

In FIG. 2, double-headed arrow D1 indicates the direction that intersects the main surface of paper P conveyed to the nip portion. MFP 500 has a mechanism that changes a relative position between fixing roller 602 and pressing roller 609 in the double-headed arrow D1 direction. This mechanism is shown as a roller position adjustment motor 65 in FIG. 3 described later. In MFP 500, for example, roller position adjustment motor 65 changes the distance between fixing roller 602 and pressing roller 609 in the double-headed arrow D1 direction to change the length of the nip portion in conveyance path 3.

[3] HARDWARE CONFIGURATION OF MFP

Figure 3:
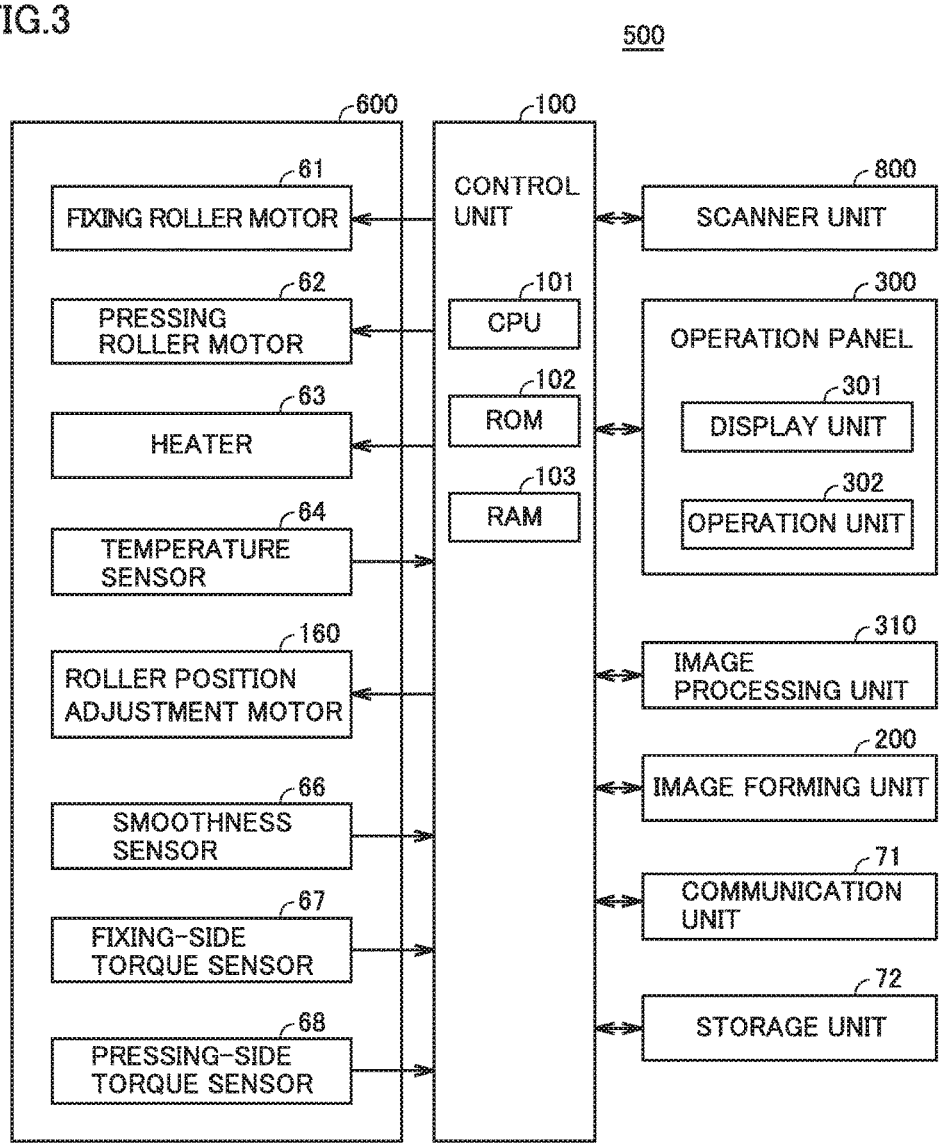
FIG. 3 is a diagram schematically showing a hardware configuration of the MFP.

FIG. 3 is a diagram schematically showing a hardware configuration of MFP 500.

As shown in FIG. 3, control unit 100 includes a CPU (Central Processing Unit) 101, a ROM (Read Only Memory) 102, and a RAM (Random Access Memory) 103. CPU 101 reads a program corresponding to the processing from ROM 102, loads the program into RAM 103, and cooperates with the loaded program to control the operation of each block of MFP 500. In doing so, a variety of data stored in storage unit 72 is referred to. Storage unit 72 is configured with, for example, a nonvolatile semiconductor memory (flash memory) and/or a hard disk drive.

Control unit 100 exchanges data with an external device (for example, personal computer) connected to a communication network such as LAN (Local Area Network) and WAN (Wide Area Network), through a communication unit 71. Control unit 100, for example, receives image data transmitted from an external device and forms an image on paper P based on this image data. Communication unit 71 is configured with, for example, a communication control card such as a LAN card.

Image reading unit 800 includes ADF 900 (see FIG. 1) and a scanner.

ADF 900 conveys an original placed on an original tray with a conveyance mechanism to output the original to an original image scanning device 12. ADF 900 can read images (including both sides) of multiple sheets of original D on the original tray successively at a time.

The scanner of image reading unit 800 optically scans an original conveyed by ADF 900 onto the contact glass or an original placed on the contact glass and forms an image of reflection light from the original on the light-receiving surface of a CCD (Charge Coupled Device) sensor to read the original image. Image reading unit 800 generates image data based on the reading result by the scanner. This image data undergoes predetermined image processing in an image processing unit 310.

Operation panel 300 is implemented, for example, by a unit with a touch panel and functions as a display unit 301 and an operation unit 302. Display unit 301 is implemented by, for example, an LCD (Liquid Crystal Display) and displays, for example, a variety of operation screens, an image status, and the operation status of functions, in accordance with a display control signal input from control unit 100. Operation unit 302 is implemented by a tenkey pad, operation keys such as start key, and a touch sensor in the touch panel. Operation unit 302 accepts a variety of input operations by users and outputs an operation signal to control unit 100.

Image processing unit 310 includes circuitry or the like to perform digital image processing on image data in accordance with initial settings or user settings. For example, image processing unit 310 performs tone correction based on tone correction data (tone correction table) under the control of control unit 100 and performs a variety of processing (including the correction processing such as tone correction, color correction, and shading correction, and the compression processing) for input image data. Control unit 100 controls image forming unit 200 based on the processed image data.

In fixing unit 60, fixing roller motor 61, pressing roller motor 62, heater 63, and roller position adjustment motor 65 are controlled by control unit 100.

Temperature sensor 64 is provided on the surface of fixing belt 605. Temperature sensor 64 and smoothness sensor 66 output the respective detection outputs to control unit 100.

MFP 500 includes a fixing-side torque sensor 67 for detecting torque of rotation of fixing roller 602 and a pressing-side torque sensor 68 for detecting torque of rotation of pressing roller 609. Fixing-side torque sensor 67 and pressing-side torque sensor 68 output the respective detection outputs to control unit 100.

[4] BASIC CONTROL OF ROTATION OF FIXING ROLLER AND PRESSING ROLLER

Figure 4:
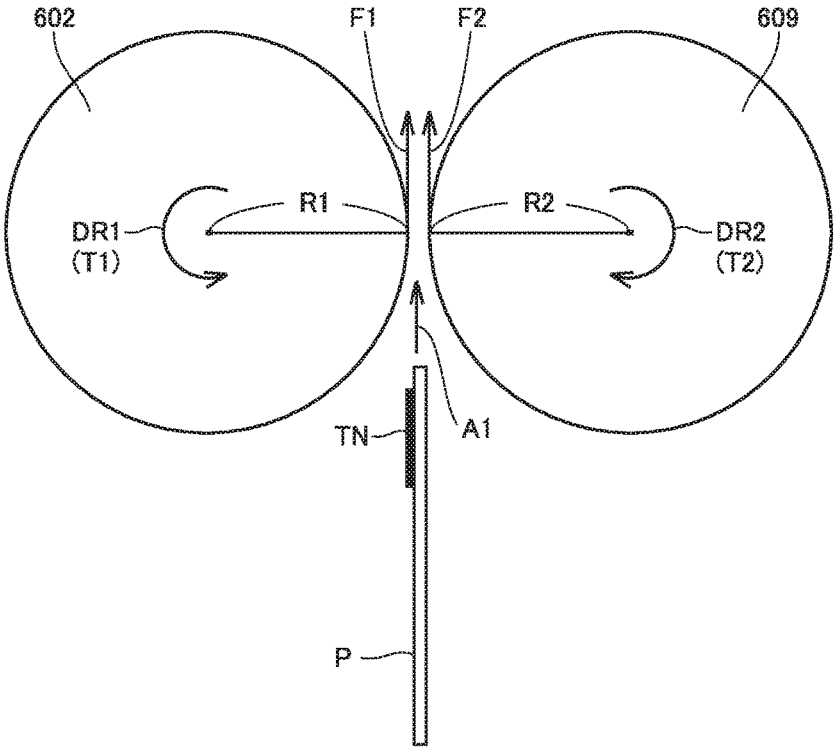
FIG. 4 is a diagram for explaining an overview of control of rotation of a fixing roller and a pressing roller by a control unit.

Control unit 100 controls rotation torques of fixing roller 602 and pressing roller 609 such that force applied to the front surface of paper P (the surface having a toner image formed thereon) and force applied to the back surface of paper P (the surface different from the surface having a toner image formed thereon) at the nip portion are adjusted. FIG. 4 is a diagram for explaining an overview of control of rotation of fixing roller 602 and pressing roller 609 by control unit 100.

As shown in FIG. 4, paper P is conveyed in the direction indicated by arrow A1 so as to pass through between fixing roller 602 and pressing roller 609. Paper P has an image formed thereon with toner TN. In FIG. 4, fixing belt 605 is not shown. The portion that holds paper P between fixing roller 602 and pressing roller 609 is the "nip portion".

Control unit 100 controls the rotation torques of fixing roller 602 and pressing roller 609 at the nip portion such that the force applied to the back surface of paper P is equal to or greater than the force applied to the front surface of paper P and that the relation between the force applied to the back surface and the force applied to the front surface changes with the smoothness of paper P.

Control unit 100 acquires the rotation torque of fixing roller 602 based on the detection output input from fixing-side torque sensor 67, acquires the rotation torque of pressing roller 609 based on the detection output input from pressing-side torque sensor 68, and performs feedback control of the rotation torques of fixing roller 602 and pressing roller 609 using the acquired two rotation torques.

Fixing-side torque sensor 67 measures, for example, a current value applied to fixing roller motor 61. In this case, information for converting a current value into a rotation torque (for example, conversion table) is stored in storage unit 72. Control unit 100 converts the current value input from fixing-side torque sensor 67 into the rotation torque of fixing roller 602. In the present description, the rotation torque of fixing roller 602 may be referred to as fixing-side torque T1.

Pressing-side torque sensor 68 measures, for example, a current value applied to pressing roller motor 62. In this case, information for converting a current value into a rotation torque (for example, table) is stored in storage unit 72. Control unit 100 converts the current value input from pressing-side torque sensor 68 into the rotation torque of pressing roller 609. In the present description, the rotation torque of pressing roller 609 may be referred to as pressing-side torque T2.

In MFP 500, fixing roller 602 abuts on paper P with fixing belt 605 interposed. In the present description, tangential force in rotation of fixing roller 602 is considered as force applied to the front surface-side of paper P. In FIG. 4, force F1 indicates the force applied to the front surface-side of paper P. Radius R1 indicates the radius of fixing roller 602. On the fixing roller 602 side, the relation between fixing-side torque T1, force F1, and radius R1 is estimated as represented by formula (1) below.

$$T1 \approx F1 \cdot R1 \quad (1)$$

In the present description, the tangential force in rotation of pressing roller 609 is considered as the force applied to the back surface-side of paper P. In FIG. 4, force F2 indicates the force applied to the back surface-side of paper P. Radius R2 indicates the radius of pressing roller 609. On the pressing roller 609 side, the relation between pressing-side torque T2, force F2, and radius R2 is estimated as represented by formula (2) below.

$$T2 \approx F2 \cdot R2 \quad (2)$$

In MFP 500, as represented by formula (3) below, the rotation of fixing roller 602 and pressing roller 609 is controlled such that force F2 is equal to or greater than force F1.

$$F1 \leq F2 \quad (3)$$

Based on this, control unit 100 executes feedback control such that fixing-side torque T1 and pressing-side torque T2 satisfy the relation represented by formula (4) below.

$$T1/R1 \leq T2/R2 \quad (4)$$

When radius R1 is equal to radius R2, formula (4) can be written as formula (5) below.

$$T1 \leq T2 \quad (5)$$

[5] PROCESS FLOW

Figure 5:
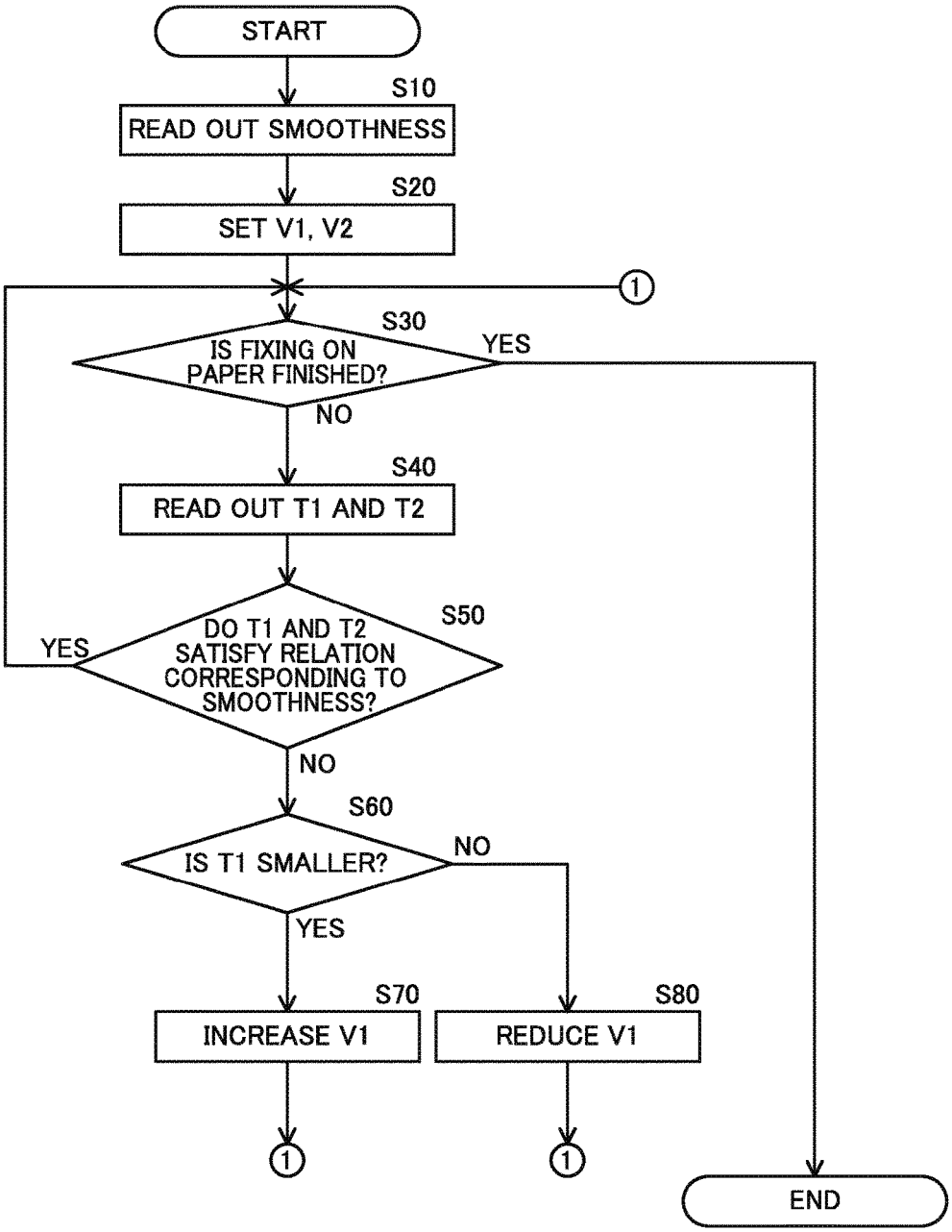
FIG. 5 is a flowchart of an example of the process performed for control of rotation of the fixing roller and the pressing roller in the MFP.

FIG. 5 is a flowchart of an example of the processing performed for control of rotation of fixing roller 602 and pressing roller 609 in MFP 500.

As shown in FIG. 5, at step S10, CPU 101 reads out the smoothness of paper P. In an example, the smoothness of paper P is input from smoothness sensor 66.

In another example, the smoothness of paper P may be input to operation unit 22. In yet another example, the smoothness of paper P may be input from another device to communication unit 71. In these examples, smoothness sensor 66 may be eliminated.

Subsequently, the control proceeds to step S20.

At step S20, CPU 101 sets rotational speed V1 of fixing roller 602 and rotational speed V2 of pressing roller 609. CPU 101 controls the torques of fixing roller motor 61 and pressing roller motor 62 so that rotational speeds V1, V2 are achieved. The torques of fixing roller motor 61 and pressing roller motor 62 for the initial values of rotational speeds V1, V2 are, for example, stored in storage unit 72 in advance. Subsequently, the control proceeds to step S30.

At step S30, CPU 101 determines whether the fixing of paper P is finished. In an example, MFP 500 includes a paper sensor at the downstream side of fixing unit 60. CPU 101 determines that the fixing of paper P is not finished until the paper sensor detects passage of paper P. CPU 101 determines that the fixing of paper P is finished when the paper sensor detects passage of paper P.

If CPU 101 determines that the fixing of paper P has not yet been finished (NO at step S30), the control proceeds to step S40. If CPU 101 determines that the fixing of paper P has been finished (YES at step S30), the process in FIG. 5 ends.

At step S40, CPU 101 reads out the values of fixing-side torque T1 and pressing-side torque T2. The values of fixing-side torque T1 and pressing-side torque T2 may be read out by reading out the current value of fixing roller motor 61 detected by fixing-side torque sensor 67 and the current value of pressing roller motor 62 detected by pressing-side torque sensor 68 and converting these two current values into torques. Subsequently, the control proceeds to step S50.

At step S50, CPU 101 determines whether the values of fixing-side torque T1 and pressing-side torque T2 read at step S40 satisfy the relation corresponding to the smoothness read at step S10. The relation of fixing-side torque T1 and pressing-side torque T2 to the smoothness of paper P is, for example, stored in storage unit 72. In this relation, the value of pressing-side torque T2 is equal to or greater than the value of fixing-side torque T1, and the higher the smoothness of paper P is, the greater the difference between the two values is. If CPU 101 determines that the values of fixing-side torque T1 and pressing-side torque T2 satisfy the relation above (YES at step S50), the control returns to step S30. If CPU 101 determines that the values of fixing-side torque T1 and pressing-side torque T2 do not satisfy the relation above (NO at step S50), the control proceeds to step S60.

At step S60, CPU 101 determines whether pressing-side torque T1 is smaller than the value defined by the relation above. If CPU 101 determines that pressing-side torque T1 is smaller than the value defined by the relation above (YES at step S60), the control proceeds to step S70. If CPU 101 determines that pressing-side torque T1 is greater than the value defined by the relation above (NO at step S60), the control proceeds to step S80.

At step S70, CPU 101 increases the rotational speed of fixing roller motor 61 so as to increase fixing-side torque T1. The control then returns to step S30.

At step S80, CPU 101 reduces the rotational speed of fixing roller motor 61 so as to reduce fixing-side torque T1. The control then returns to step S30.

[6] PREFERABLE CONDITIONS

[6-1] Smoothness of Paper and Tangential Force on Paper

Figure 6:
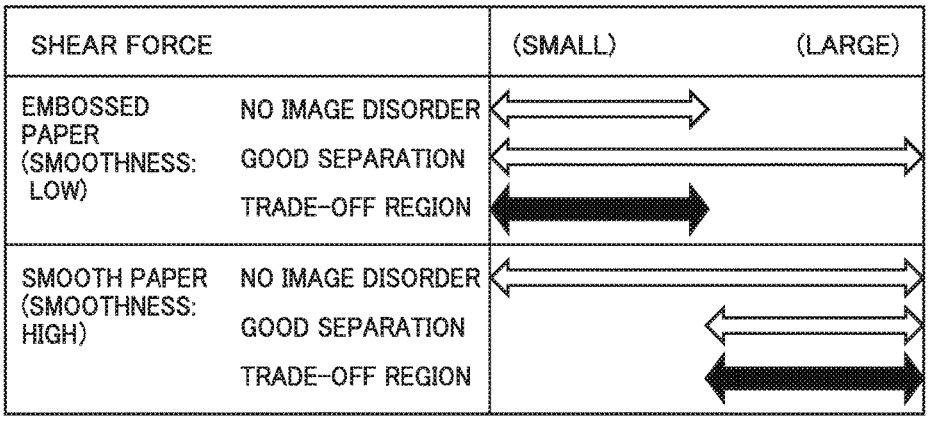
FIG. 6 is a diagram showing the relation between the shear force applied on a surface of paper having a toner image and the quality of image, for each kind of paper.

FIG. 6 is a diagram showing the relation between the shear force applied to the surface of paper having a toner image formed thereon and the quality of image, for each kind of paper. In FIG. 6, embossed paper is illustrated as an example of paper P having a surface with a relatively low smoothness, and smooth paper is illustrated as an example of paper with a relatively high smoothness.

An example of the embossed paper is LEZAK 66 (manufactured by OSTRICHDIA CO., LTD., 151 g/$m^2$, Bekk smoothness 2 sec). An example of the smooth paper is OK TOPCOAT (manufactured by OJI PAPER CO., LTD., 85 g/$m^2$, Bekk smoothness 1600 sec). The higher value of Bekk smoothness means that the smoothness is high.

In FIG. 6, "no image disorder" and "good separation" are illustrated as the quality of image. "No image disorder" refers to that there is no disorder in the image formed on paper. For example, "no image disorder" is specified based on the result of reading by the scanner for a region where a black image is to be formed in paper P output from MFP 500 after image formation. More specifically, when the BW ratio (black-white ratio) is 99.5% or more in the result of reading this region, the result is "no image disorder".

"Good separation" refers to that separation of paper from the fixing roller is good. For example, it refers to that separation of paper from the fixing roller is good. For example, "good separation" is the result obtained when paper having a white region (region where no image is formed) 5 mm from the front end in the conveyance direction and having a toner image on the back is conveyed to fixing unit 60 and discharged from fixing unit 60 without being caught by fixing roller 602.

In FIG. 6, the double-headed arrow shows the range in which "no image disorder" or "good separation" is achieved.

According to FIG. 6, in embossed paper, "good separation" is achieved irrespective of the magnitude of shear force applied to paper P. On the other hand, "no image disorder" is achieved when the shear force applied to paper P is relatively small, but not achieved when the shear force is relatively large. Based on this, as denoted as "trade-off region" for embossed paper in FIG. 6, when embossed paper is used as paper P, a relatively small shear force applied to paper P achieves a trade-off between "no image disorder" and "good separation".

On the other hand, in smooth paper, "no image disorder" is achieved irrespective of the magnitude of shear force applied to paper P. On the other hand, "good separation" is achieved when the shear force applied to paper P is relatively large, but not achieved when the shear force is relatively small. Based on this, as denoted as "trade-off region" for smooth paper in FIG. 6, when smooth paper is used as paper P, a relatively large shear force applied to paper P achieves a trade-off between "no image disorder" and "good separation".

According to FIG. 6, the shear force applied to paper P may be relatively small when paper P is embossed paper, whereas the shear force applied to paper P may be relatively small when paper P is smooth paper. Based on this, the shear force applied to paper P may increase as the smoothness of the surface of paper P increases.

The shear force applied to the surface having an image formed thereon in paper P increases as the difference increases between force F1 (see FIG. 4) applied to the front surface of paper P and F2 (see FIG. 4) applied to the back surface.

In the present description, force F1 is considered as tangential force in rotation of fixing roller 602. That is, the relation between force F1 and fixing-side torque T1 is considered to satisfy formula (1) ($T1 \approx F1 \cdot R1$). Force F2 is considered as tangential force in rotation of pressing roller 906. That is, the relation between force F2 and heating-side torque T2 is assumed as formula (2) ($T2 \approx F2 \cdot R2$). For example, when R1 is equal to R2, the magnitude relation between force T1 and force T2 agrees with the magnitude relation between fixing-side torque T1 and pressing-side torque T2. Therefore, control unit 100 controls the rotation of fixing roller 602 and pressing roller 609 such that as the smoothness of the front surface of paper P increases, the difference between fixing-side torque T1 and pressing-side torque T2 is increased in order to increase the shear force applied to paper P.

Furthermore, as described with reference to FIG. 4, control unit 100 controls the rotation of fixing roller 602 and pressing roller 609 such that the relation represented by formula (4) ($T1/R1 \leq T2/R2$) is satisfied.

Figure 7:
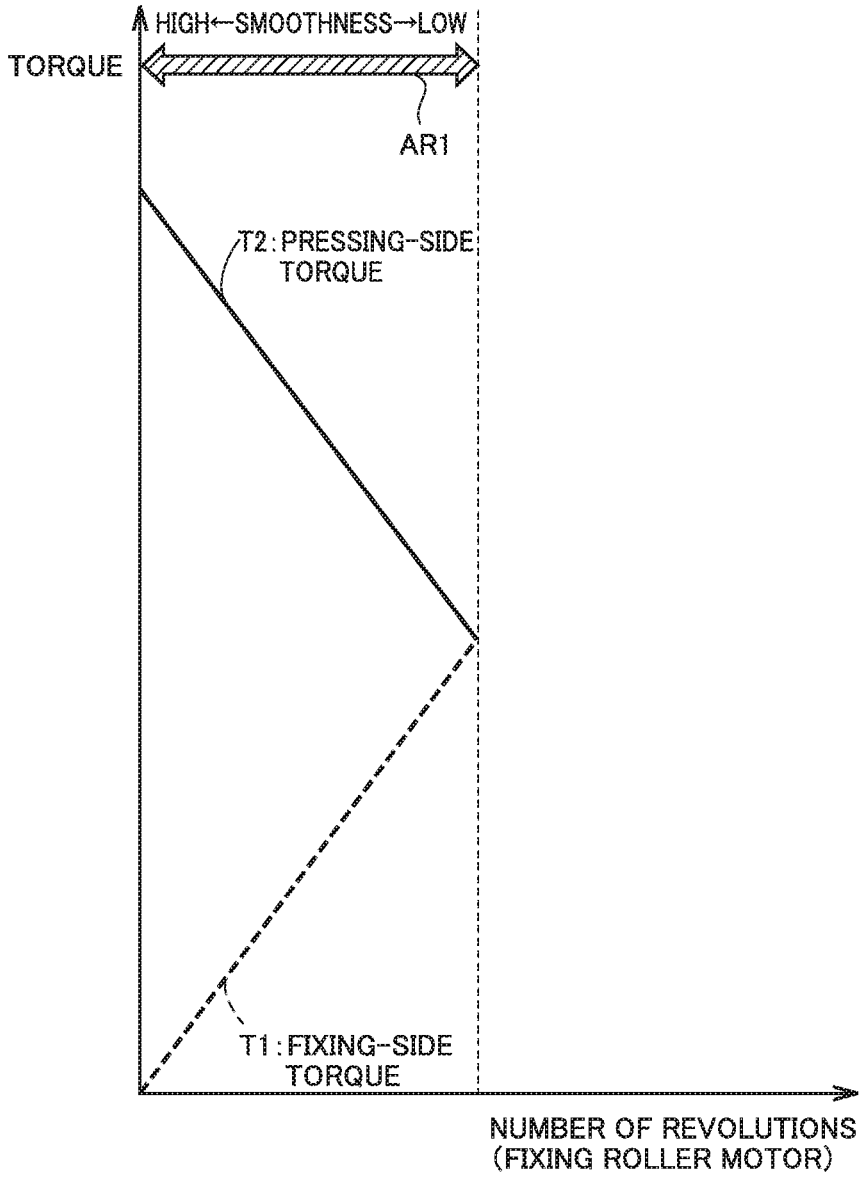
FIG. 7 is a diagram schematically showing the relation between fixing-side torque T1 and pressing-side torque T2 in the MFP.

FIG. 7 is a diagram schematically showing the relation between fixing-side torque T1 and pressing-side torque T2 in MFP 500. The vertical axis in FIG. 7 shows these two torques. The horizontal axis shows the number of revolutions of fixing roller motor 61. In MFP 500, control unit 100 controls pressing roller motor 62 so as to rotate at a certain number of revolutions. Thus, as shown in FIG. 7, when control unit 100 increases the number of revolutions of fixing roller motor 61, fixing-side torque T1 increases while pressing-side torque T2 decreases.

In MFP 500, when the radius of fixing roller 602 and the radius of pressing roller 609 are equal (R1=R2 in FIG. 4), control unit 100 controls the rotation of fixing roller 602 and pressing roller 609 such that the relation as represented by formula (5) above ($T1 \leq T2$) is satisfied. In such a case, control unit 100 controls the number of revolutions of fixing roller motor 61 in a range shown in FIG. 7, that is, in a range in which the relation "$T1 \leq T2$" is satisfied.

Control unit 100 may control the rotational speed, rather than controlling the number of revolutions of fixing roller motor 61 and/or pressing roller motor 62.

In MFP 500, control unit 100 may control the rotation of fixing roller 602 and pressing roller 609 such that the difference between force F1 and force F2 (see FIG. 4) increases as the smoothness of paper decreases. Double-headed arrow AR1 at the top of FIG. 7 indicates the preferable relation of the smoothness of paper P to fixing-side torque T1 and pressing-side torque T2 in MFP 500. That is, as the smoothness of paper decreases, the difference between pressing-side torque T2 and fixing-side torque T1 increases.

Letting fixing-side torque T1 and pressing-side torque T2 for smooth paper be fixing-side torque T1L for smooth paper and pressing-side torque T2L for smooth paper, respectively, the ratio between them may be about T1L:T2L=1:100 to 1:5. On the other hand, letting fixing-side torque T1 and pressing-side torque T2 for embossed paper be fixing-side torque T1H for embossed paper and pressing-side torque T2H for smooth paper, respectively, the ratio between them may be about T1H:T2H=1:10 to 1:1. Here "H" and "L" mean the coarseness of the surface of paper P. More specifically, "H" corresponds to a high coarseness of the surface of paper P (that is, low smoothness). "L" corresponds to a low coarseness of the front surface of paper P (that is, high smoothness).

The value of pressing-side torque T2 (T2H) for embossed paper may be not more than 0.9 time the value of pressing-side torque T2 (T2L) for smooth paper.

In MFP 500, the rotation torque is changed, for example, by changing the pulse width of the motor (PWM control). In order to reduce pressing-side torque T2, the PWM of fixing roller motor 61 is increased. As a result, the assist force of fixing roller 602 (force in the paper conveyance direction) is increased. Accordingly, the shear force applied to paper P is reduced.

[6-2] Hardness of Fixing Belt

Figure 9:
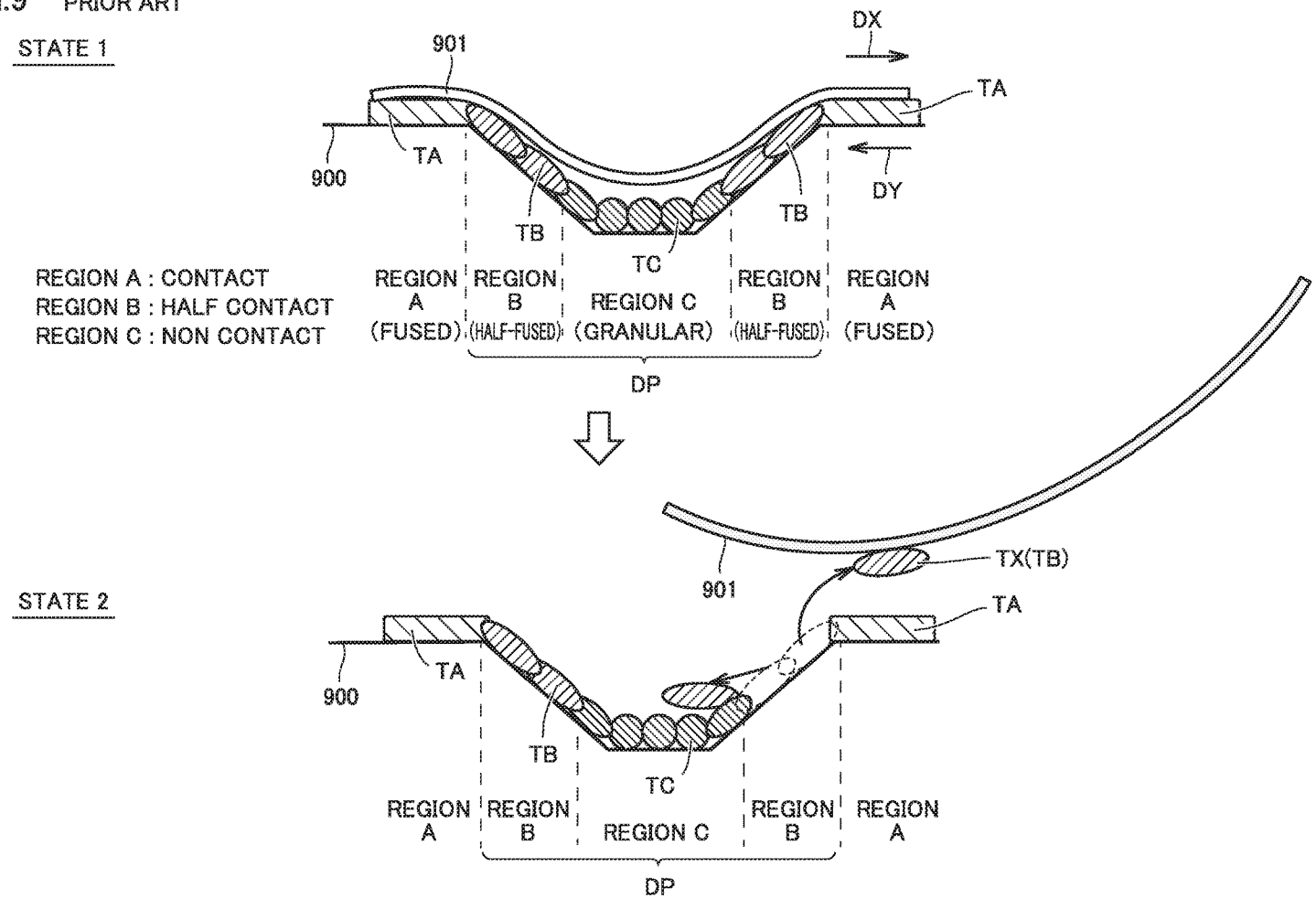
FIG.9 PRIOR ART
FIG. 9 is a diagram for explaining one of factors causing image disorder in a conventional image forming apparatus.

In MFP 500, when the hardness of fixing belt 605 decreases (that is, fixing belt 605 is soft), as denoted as region B in FIG. 9, the region of fixing belt 605 in contact with the depressed portion of paper P at an angle increases. This is thought to increase the possibility that disorder of a toner image occurs in paper P. On the other hand, when the hardness of fixing belt 605 is too high, the area of the portion of fixing belt 605 in contact with the protruding portion of paper P decreases to possibly reduce the strength of fixing of toner on paper P.

Based on these, in MFP 500, it may be that the upper limit and the lower limit of hardness of fixing belt 605 are set. For example, the MD-1 hardness (type C) of fixing belt 605 may not be less than 85° and not more than 95°.

[6-3] Control Depending on Nip Portion

As roller position adjustment motor 65 is shown in FIG. 3, the length of the nip portion can be changed in MFP 500. The longer the nip portion, the greater the shear force applied to paper P in the nip portion as a whole. Based on this, control unit 100 controls the rotation of fixing roller 602 and pressing roller 609 such that the difference between force F1 applied to paper P from the fixing roller 602 side and force F2 applied to paper P from the pressing roller 609 side decreases as the length of the nip portion increases.

[7] PREPARATION OF TONER

A method of preparing toner for use in image formation in MFP 500 will be described.

[7-1] Base Particles of Toner

Toner used in MFP 500 includes, as a toner base particle, at least binder resin and wax. They will be described below.

[7-1-1] Binder Resin

The binder resin to form toner particles is not limited to particular kinds. That is, the binder resin to form toner particles may be formed of a variety of substances known as binder resin. Examples of the binder resin include styrene resins, acrylic resins, styrene-acrylic resins, polyester resins, silicone resins, olefin resins, amide resins, and epoxy resins.

The binder resin may contain a styrene-acrylic resin in terms of toner particle size, shape controllability, and charging property. A polymerizable monomer for obtaining the styrene-acrylic resin is, for example, a styrene-based monomer such as styrene, methylstyrene, methoxystyrene, butylstyrene, phenylstyrene, and/or chlorostyrene. The monomer may be a (meth)acrylate ester-based monomer such as methyl(meth)acrylate, ethyl(meth)acrylate, butyl(meth)acrylate, and ethylhexyl(meth)acrylate. The monomer may be a carboxylic monomer such as acrylic acid, methacrylic acid, and fumaric acid. These monomers may be used singly or in combination of two or more.

The glass transition point (Tg) of the binder resin is preferably 30 to 50° C., more preferably 35 to 48° C. When the glass transition point of the binder resin is within the range above, both of low-temperature fixing property and heat-resistant storability can be achieved. The glass transition point of the binder resin is measured, for example, using "Diamond DSC" (manufactured by Perkin Elmer Co., Ltd.).

In the measurement, for example, 3.0 mg of a sample (binder resin) is sealed in an aluminum pan and set in a holder. An empty aluminum pan is used as a reference. The measurement conditions are, for example, measurement temperature of 0° C. to 200° C., temperature increase rate of 10° C./min, and temperature drop rate of 10° C./min. The temperature control of Heat-Cool-Heat is performed, and data obtained in the second Heat in the temperature control is used for analysis. Given the extended line of the base line before rising of the first endothermic peak and the tangent showing the maximum slope from the rising of the first peak to the peak top, the intersection thereof is an example of the glass transition point.

[7-1-2] Wax

In MFP 500, a known wax can be used as the wax contained in toner. Examples of the wax include polyolefin waxes such as polyethylene wax and polypropylene wax, and branched-chain hydrocarbon waxes such as microcrystalline wax. Other examples of the wax include long-chain hydrocarbon-based waxes such as paraffin wax and Sasolwax, dialkyl ketone-based waxes such as distearyl ketone, carnauba wax, montan wax, ester-based waxes such as behenic acid behenate, trimethylolpropane tribehenate, pentaerythritol tetrabehenate, pentaerythritol diacetate dibehenate, glycerol tribehenate, 1,18-octadecane diol distearate, trimellitic acid tristearyl, and distearyl maleate, and amide-based waxes such as ethylene diamine behenyl amide and trimellitic acid tristearyl amide. Among those substances, in terms of suppressing gloss unevenness, branched-chain hydrocarbon waxes such as microcrystalline wax are particularly preferable.

The melting point of the wax contained in toner is preferably 70 to 100° C., more preferably 70 to 85° C. The melting point of the wax shows the temperature at the peak top of the endothermic peak and is measured by DSC (differential scanning calorimetry) using a differential scanning calorimeter "DSC-7" (manufactured by Perkin Elmer Co., Ltd.) and a thermal analyzer controller "TACT/DX" (manufactured by Perkin Elmer Co., Ltd.).

In an example of the measurement, specifically, 4.5 mg of a sample (wax) was sealed in an aluminum pan (KITN0.0219-0041), which is then set in a sample holder of "DSC-7". The temperature control of Heating-Cooling-Heating is performed under measurement conditions of measurement temperature of 0 to 200° C., temperature increase rate 10° C./min, and temperature drop rate of 10° C./min. Data obtained in the second heating in the temperature control is to be analyzed. In measurement of a reference, for example, an empty aluminum pan is used.

The wax content is preferably 1 to 30 parts by mass with respect to 100 parts by mass of the binder resin, more preferably 5 to 20 parts by mass. The wax content within the range above achieves fixing separation property.

[7-2] Coloring Agent

When the toner particles contain a coloring agent, generally known dye and pigment can be used as a coloring agent.

As a coloring agent for obtaining black toner, a variety of known agents such as carbon blacks such as furnace black and channel black, magnetic substances such as magnetite and ferrite, dyes, and inorganic pigments including non-magnetic iron oxides can be used.

As a coloring agent for obtaining color toner, known agents such as dyes and organic pigments can be used. Specifically, examples of the organic pigment include C.I. pigment reds 5, 48:1, 53:1, 57:1, 81:4, 122, 139, 144, 149, 166, 177, 178, 222, 238, 269, C.I. pigment yellows 14, 17, 74, 93, 94, 138, 155, 180, 185, C.I. pigment oranges 31, 43, and C.I. pigment blues 15; 3, 60, 76. Examples of the dye include C.I. solvent reds 1, 49, 52, 58, 68, 11, 122, C.I. solvent yellows 19, 44, 77, 79, 81, 82, 93, 98, 103, 104, 112, 162, and C.I. solvent blues 25, 36, 69, 70, 93, 95.

The coloring agents for obtaining toner of each color can be used singly or in combination of two or more.

The coloring agent content is preferably 1 to 10 parts by mass with respect to 100 parts by mass of the binder resin, more preferably 2 to 8 parts by mass.

[7-3] Charge Control Agent

When the toner particles contain a charge control agent, a known positive charge control agent or negative charge control agent can be used.

Specific examples of the positive charge control agent include nigrosine-based dyes such as "Nigrosine Base EX" (manufactured by Orient Chemical Industries Co., Ltd.), quaternary ammonium salts such as "quaternary ammonium salt P-51" (manufactured by Orient Chemical Industries Co., Ltd.) and "Copy Charge PXVP435" (manufactured by Hoechst Japan), alkoxylated amine, alkylamide, molybdate chelate pigment, and imidazole compounds such as "PLZ1001" (manufactured by SHIKOKU CHEMICALS CORPORATION).

Specific examples of the negative charge control agent include metal complexes such as "BONTRON S-22" (manufactured by Orient Chemical Industries Co., Ltd.), "BONTRON S-34" (manufactured by Orient Chemical Industries Co., Ltd.), "BONTRON E-81" (manufactured by Orient Chemical Industries Co., Ltd.), "BONTRON E-84" (manufactured by Orient Chemical Industries Co., Ltd.), and "Spilon black TRH" (manufactured by HODOGAYA CHEMICAL CO., LTD.), thioindigo pigments, quaternary ammonium salts such as "Copy Charge NXVP434" (manufactured by Hoechst Japan), calixarene compounds such as "BONTRON E-89" (manufactured by Orient Chemical Industries Co., Ltd.), boron compounds such as "LR147" (manufactured by Japan Carlit Co., Ltd.), and fluorine compounds such as magnesium fluoride and carbon fluoride. Specific examples of the metal complex used as a negative charge control agent include, in addition to those listed above, oxycarboxylic acid metal complexes, dicarboxylic acid metal complexes, amino acid metal complexes, diketone metal complexes, diamine metal complexes, azo group-containing benzene-benzene derivative skeleton metal complexes, and azo group-containing benzene-naphthalene derivative skeleton metal complexes.

The charge control agent content is preferably 0.01 to 30 parts by mass with respect to 100 parts by mass of the binder resin, more preferably 0.1 to 10 parts by mass.

[7-4] External Additive

An external additive may be added to toner in terms of improvement in flowability, charging property, and cleaning property.

The external additive is, for example, inorganic fine particles. Examples of the inorganic fine particles include inorganic oxide fine particles such as silica fine particles, alumina fine particles, and titanium oxide fine particles, inorganic stearic acid compound fine particles such as aluminum stearate fine particles and zinc stearate fine particles, and inorganic titanium acid compound fine particles such as strontium titanate and zinc titanate.

The inorganic fine particles above may be surface-treated with, for example, a silane coupling agent, a titanium coupling agent, a higher fatty acid, or silicone oil, in terms of heat-resistant storability and environmental stability.

The average primary particle size of the inorganic fine particles forming the external additive may be 30 nm or smaller.

When the external additive composed of inorganic fine particles has the particle size above, liberation of the external additive is less likely to occur in toner during image formation.

The amount of addition of the external additive may be 0.05 to 5% by mass in toner, 0.1 to 3% by mass.

[7-5] Developer

The toner used in MFP 500 may be used in the form of a magnetic or non-magnetic single-component toner or may be mixed with a carrier to be used as a two-component toner.

When the toner is used as a two-component developer, the carrier is, for example, magnetic particles of a conventionally known material. Examples of the magnetic particles include ferromagnetic metals such as iron, alloys of ferromagnetic metals with aluminum, lead, and the like, and ferromagnetic metal compounds such as ferrite and magnetite. In particular, ferrite particles are preferred.

The carrier is, for example, a coat carrier obtained by coating the surfaces of magnetic particles with a coating agent such as resin or a binder-type carrier obtained by dispersing magnetic fine particles in a binder resin.

The coating resin for the coat carrier is not limited to particular kinds. Examples of the coating resin include olefin-based resins, styrene-based resins, styrene-acrylic resin, silicone-based resins, ester resins, and fluoroplastics.

The resin for the resin dispersion-type carrier is not limited to particular kinds. Examples of the resin for the resin dispersion-type carrier include styrene-acrylic resins, polyester resins, fluoroplastics, and phenolic resins.

In MFP 500, when the toner is used as a two-component developer, the two-component developer may be prepared, for example, by adding a charge control agent, an adhesion enhancer, a primer treatment agent, a resistance control agent, and the like to the toner and the carrier, if necessary.

[7-6] Average Particle Size of Toner Particles

The average particle size of toner particles used in MFP 500 is, for example, preferably 3 to 9 μm, more preferably 3 to 8 μm in terms of the volume median diameter. When toner particles are manufactured by the emulsion aggregation process described later, the particle size may be controlled, for example, by the concentration of a flocculating agent used, the amount of an organic solvent added, the fusion time, and/or the composition of polymer.

The volume median diameter within the range above increases the transfer efficiency thereby to improve the image quality of half tone in the image formed on paper P and further improve the image quality of thin lines and dots.

The volume median diameter of the toner particles may be measured and calculated, for example, using a measurement apparatus including "Multisizer 3" (manufactured by Beckman Coulter, Inc.) connected to a computer system loaded with data processing software "SoftwareV3.51".

Specifically, 0.02 g of a sample (toner particles) is added to, for example, 20 mL of a surfactant solution (surfactant solution obtained by diluting a neutral detergent, including a surfactant component, 10-fold with pure water for the purpose of dispersing toner particles). Subsequently, the sample added to the surfactant solution is subjected to ultrasonic dispersion for one minute to prepare a toner particle dispersion liquid. This toner particle dispersion liquid is poured into a beaker containing "ISOTONII" (manufactured by Beckman Coulter, Inc.) in a sample stand, for example, with a pipet until the display density of the measurement apparatus reaches 8%. A reproducible measurement value can be obtained by adjustment in this density range. Subsequently, in the measurement apparatus, the measured particle count is set to 25000, and the aperture diameter is set to 50 μm. The measurement range, that is, the range of 1 to 30 μm is divided into 256 to calculate the frequency value. The particle size within 50% from the highest volume cumulative fraction is specified as the volume median diameter of toner particles.

[7-7] Average Circularity of Toner Particles

The toner particles used in MFP 500 preferably have an average circularity of 0.930 to 1.000, more preferably 0.950 to 0.995, in terms of improvement in transfer efficiency. The average circularity of toner particles is measured, for example, using "FPIA-2100" (manufactured by Sysmex Corporation).

Specifically, for example, after a sample (toner particles) is added to an aqueous solution including a surfactant, ultrasonic dispersion is performed for one minute. The toner particles are then dispersed in the aqueous solution. Subsequently, imaging is performed using "FPIA-2100" (manufactured by Sysmex Corporation) under measurement conditions: HPF (high magnification imaging) mode and a proper density, that is, HPF detection count of 3,000 to 10,000. The circularity for each individual toner particle is thus calculated according to formula (T) below.

Circularity=(the peripheral length of a circle having the same projection area as the particle image)/(the peripheral length of the particle projection image) formula (T)

The average circularity is calculated, for example, by dividing the value of the sum of the circularity of toner particles by the total number of toner particles.

[7-8] Toner Storage Elastic Modulus

The toner used in MFP 500 preferably has a storage elastic modulus (G' 60) of $1\times10^8$ Pa or less at a temperature of 60° C. when embossed paper is used as paper P. This is because the insufficiency of strength of toner placed in the depressed portion of embossed paper is eliminated.

The viscoelasticity of toner is measured, for example, using a viscoelasticity measurement apparatus (rheometer) "RDA-II" (manufactured by Rheometric Scientific, Inc.).

For example, a parallel plate having a diameter of 10 mm may be used as a measurement jig.

For example, toner formed into a cylindrical sample about 10 mm in diameter and 1.5 to 2.0 mm in height after heating and melting may be used as a measurement sample.

The measurement frequency is, for example, 6.28 radian/second.

The initial value of measurement strain is set to, for example, 0.1%. The measurement may be performed, for example, in an automatic measurement mode.

The sample elongation correction is performed, for example, in an automatic measurement mode.

[7-9] Toner Production Method

As a toner production method, for example, kneading/pulverization, emulsion dispersion, suspension polymerization, dispersion polymerization, emulsion polymerization, emulsion polymerization aggregation, mini-emulsion polymerization aggregation, capsulation, or other known processes may be employed. Preferably, considering that toner with a small particle size has to be obtained in order to achieve high image quality, the emulsion polymerization aggregation process is employed in view of production costs and production stability. The emulsion polymerization aggregation process is a method of producing toner by mixing a dispersion liquid including fine particles of a binder resin (which hereinafter may be referred to as "binder resin fine particles") produced by the emulsion polymerization process with a dispersion liquid of fine particles of a coloring agent (which hereinafter may be referred to as "coloring agent fine particles"), allowing the particles to slowly aggregate while balancing the repulsive force of fine particle surface by pH control and the aggregation force by addition of a flocculating agent of electrolyte, and assembling the particles while controlling the average particle size and the particle size distribution, and at the same time, performing heating to fuse the fine particles for shape control.

When the emulsion polymerization aggregation process is employed as a toner production method, binder resin fine particles are formed. This binder resin fine particle may have two or more layers composed of binder resins with different compositions. In this case, a polymerization initiator and a polymerizable monomer may be added to a dispersion liquid of first binder resin fine particles prepared by an emulsion polymerization process (first stage polymerization) according to the usual method, and thereafter the system may undergo a polymerization process (second stage polymerization).

The toner may have a core-shell structure. In a method of producing toner having a core-shell structure, first, core particles are prepared by allowing core binder resin fine particles and coloring agent fine particles to assemble, aggregate, and fuse. Subsequently, in order to form a shell layer in a dispersion liquid of the core particles, shell binder resin fine particles are added to the core particles. Then, the shell binder resin fine particles aggregate and fuse on the core particle surface to form a shell layer covering the core particle surface.

A specific example of the toner production method in a case where the toner has a core-shell structure will be described. The toner production method includes (Step 1) to (Step 8) below.

(Step 1) Coloring agent fine particles dispersion liquid preparation step: preparing a dispersion liquid of coloring agent fine particles, in which a coloring agent is dispersed in the form of fine particles.

(Step 2-1) Core binder resin fine particles polymerization step: obtaining core binder resin fine particles of a core binder resin containing main wax and internal additive to prepare a dispersion liquid of the fine particles.

(Step 2-2) Shell binder resin fine particles polymerization step: obtaining shell binder resin fine particles of a shell binder resin and then preparing a dispersion liquid of the fine particles.

(Step 3) Aggregation and fusion step: allowing the core binder resin fine particles and the coloring agent fine particles to aggregate and fuse in a water-based medium to form assembled particles serving as a core particle.

(Step 4) First aging step: controlling the shape of the assembled particles by aging with thermal energy to obtain core particles.

(Step 5) Shell layer forming step: adding the shell binder resin fine particles to form shell layers in the dispersion liquid of core particles to allow the shell binder resin fine particles to aggregate and fuse on the surface of the core particle to form a particle having a core-shell structure.

(Step 6) Second aging step: aging the particles having the core-shell structure with thermal energy to control the shape of the particles thereby obtaining toner particles having the core-shell structure.

(Step 7) Filtration and washing step: separating the toner particles from the cooled toner particle dispersion system (water-based medium) and removing surfactant and others from the toner particles.

(Step 8) Drying step: drying the washed toner particles.

The toner production method includes the (Step 9) below after the drying step (Step 8), if necessary.

(Step 9) External additive step: adding an external additive to the dried toner particles.

Each step will be described below.

(Step 1) Coloring Agent Fine Particles Dispersion Liquid Preparation Step

In this step, a dispersion liquid of coloring agent fine particles, in which a coloring agent is dispersed in the form of fine particles, is prepared by adding a coloring agent into a water-based medium and performing a dispersion process using a disperser. Specifically, the process of dispersing the coloring agent is performed in a water-based medium in a state in which the surfactant concentration is set to the critical micelle concentration (CMC) or higher. Any disperser can be used in the dispersion process. Preferable examples of the disperser include ultrasonic dispersers, mechanical homogenizers, Manton Gaulin, pressure dispersers such as high pressure homogenizers, sand grinders, and medium-type dispersers such as Goetzman Mill and Diamond Fine Mill.

The dispersion diameter of the coloring agent fine particles in the coloring agent fine particles dispersion liquid is preferably 40 to 200 nm in terms of volume median diameter.

The volume median diameter of the coloring agent fine particles is measured using, for example, "MICROTRACUPA-150 (manufactured by HONEYWELL)". The measurement conditions are, for example, as follows.

Sample index of refraction 1.59

Sample specific gravity 1.05 (in terms of spherical particles)

Solvent index of refraction 1.33

Solvent viscosity 0.797 (30° C.), 1.002 (20° C.)

Ion exchange water is added to a measurement cell for zero-point adjustment.

(Step 2-1) Core Binder Resin Fine Particles Polymerization Step

This step includes a process of performing a polymerization process to prepare a dispersion liquid of core binder resin fine particles of a core binder resin containing main wax, an internal additive, and the like.

In a preferable example of the polymerization process in this step, to a water-based medium containing a surfactant at the critical micelle concentration (CMC) or higher, a polymerizable monomer solution containing main wax, an internal additive, and the like as necessary is added and subjected mechanical energy to form droplets. Subsequently, a water-soluble polymerization initiator is added to allow the polymerization reaction to proceed in the droplets.

An oil-soluble polymerization initiator may be added to the droplets. In such a step, a process of applying mechanical energy to forcedly perform emulsification (form droplets) is essential.

The above-noted mechanical energy is applied by, for example, an apparatus that applies intensive stirring or ultrasonic vibration energy, such as a homomixer, ultrasound, or Manton Gaulin.

[Surfactant]

A surfactant used in the water-based medium used as the coloring agent fine particles dispersion liquid or in the water-based medium used as a medium for polymerization of the core binder resin fine particles will be described.

The surfactant may be, but not limited to, an ionic surfactant such as sulfonic acid salt (sodium dodecylbenzenesulfonate, sodium arylalkylpolyethersulfonate), sulfate ester salt (such as sodium dodecylsulfate, sodium tetradecylsulfate, sodium pentadecylsulfate, and sodium octylsulfate), and fatty acid salt (such as sodium oleate, sodium laurate, sodium caprate, sodium caprylate, sodium caproate, potassium stearate, and calcium oleate). The surfactant may be a nonionic surfactant such as polyethylene oxide, polypropylene oxide, a combination of polypropylene oxide and polyethylene oxide, ester of polyethylene glycol and higher fatty acid, alkylphenol polyethylene oxide, ester of higher fatty acid and polyethylene glycol, ester of higher fatty acid and polypropylene oxide, and sorbitan ester.

A polymerization initiator and a chain transfer agent used for the core binder resin fine particles polymerization step will be described below.

[Polymerization Initiator]

Examples of the water-soluble polymerization initiator include persulfate such as potassium persulfate and ammonium persulfate, azobisaminodipropane acetate, azobiscyanovaleric acid and a salt thereof, and hydrogen peroxide.

The oil-soluble polymerization initiator is, for example, an azo or diazo polymerization initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, a peroxide-based polymerization initiator such as benzoyl peroxide, methylethylketone peroxide, diisopropylperoxycarbonate, cumene hydroperoxide, t-butylhydroperoxide, di-t-butylperoxide, dicumyl peroxide, 2,4-dichlorobenzoylperoxide, lauroyl peroxide, 2,2-bis-(4,4-t-butylperoxycyclohexyl)propane, and tris-(t-butylperoxy) triazine, or a polymer initiator having peroxide in a side chain.

[Chain Transfer Agent]

In the present embodiment, a generally used chain transfer agent can be used for the purpose of adjusting the molecular weight of the resultant core binder resin. Examples of the chain transfer agent include, but not limited to, mercaptans such as n-octylmercaptan, n-decylmercaptan and tert-dodecylmercaptan, mercaptopropionate esters such as n-octyl-3-mercaptopropionate ester, terpinolene, and α-methylstyrene dimer.

(Step 2-2) Shell Binder Resin Fine Particles Polymerization Step

This step includes, for example, a polymerization process and a process of preparing a dispersion liquid of shell binder resin fine particles of a shell binder resin, in the same manner as the core binder resin fine particles polymerization step (2-1) above.

(Step 3) Aggregation and Fusion Step

This step includes a process of allowing the core binder resin fine particles and the coloring agent fine particles to aggregate and fuse in a water-based medium to form assembled particles serving as a core particle. The method of aggregation and fusion in this step is, for example, a salting out/fusion process using the coloring agent fine particles obtained in (Step 1) and the core binder resin fine particles obtained in (Step 2-1).

In this step (Step 3), aggregation/fusion of wax fine particles and/or internal additive fine particles such as a charge control agent may be performed, together with the core binder resin fine particles and the coloring agent fine particles.

"Salting out/fusion" refers to allowing aggregation and fusion to proceed in parallel and, when the particles are grown to a desired particle size, adding an aggregation stopping agent to stop particle growth, and further continuously performing heating for controlling the particle shape, if necessary.

In the salting out/fusion process, aggregation and fusion are performed simultaneously while salting-out is allowed to proceed, by adding a salting-out agent composed of an alkali metal salt or an alkaline-earth metal salt, a trivalent salt, and the like as a flocculating agent at the critical micelle concentration or higher in the water-based medium containing the core binder resin fine particles and the coloring agent fine particles, and then heating to a temperature equal to or higher than the glass transition point of the core binder resin fine particles and equal to or higher than the melting peak temperature of the core binder resin fine particles and the coloring agent fine particles. The metal of the alkali metal salt and the alkaline-earth metal salt, which are salting-out agents, may be an alkaline metal (for example, lithium, potassium, sodium) or may be an alkaline-earth metal (for example, magnesium, calcium, strontium, barium). The metal is preferably potassium, sodium, magnesium, calcium, or barium.

When (Step 3) aggregation and fusion step is performed by salting out/fusion, preferably, the standing time after addition of the salting-out agent is minimized. The reason for this is not clear but a possible reason is that, for example, the aggregation state of particles changes due to the standing time after salting-out to cause the particle size distribution unstable or change the surface property of the fused toner. The temperature for adding the salting-out agent must be at least equal to or lower than the glass transition point of the core binder resin fine particles. The reason for this is as follows. If the temperature for adding the salting-out agent is equal to or higher than the glass transition point of the core binder resin fine particles, the salting out/fusion of the core binder resin fine particles proceeds quickly, while the particle size fails to be controlled, for example, large-diameter particles may be produced. The temperature for addition is set in a range equal to or lower than the glass transition point of the binder resin, generally 5 to 55° C., preferably 10 to 45° C.

After the salting-out agent is added at a temperature equal to or higher than the glass transition point of the core binder resin fine particles, the temperature is increased as quickly as possible to a temperature equal to or higher than the glass transition point of the core binder resin fine particles and equal to or higher than the melting peak temperature (° C.) of the core binder resin fine particles and the coloring agent fine particles. The time taken for the temperature increase may be shorter than one hour. In order to increase the temperature quickly, the temperature increase rate may be 0.25° C./min or more. The upper limit may not be clear but 5° C./min or less, because if the temperature is increased instantaneously, salting out proceeds rapidly to make it difficult to control the particle size. The salting out/fusion process described above thus yields a dispersion liquid of assembled particles (core particle) formed by salting out/fusion of the core binder resin fine particles and any given fine particles.

The "water-based medium" refers to a medium composed of 50 to 100% by mass of water and 0 to 50% by mass of a water-soluble organic solvent. Examples of the water-soluble organic solvent include methanol, ethanol, isopropanol, butanol, acetone, methyl ethyl ketone, and tetrahydrofuran. Among these, an alcohol-based organic solvent that does not dissolve the generated resin is preferred.

(Step 4) First Aging Step

In this step, a process of aging the assembled particles through thermal energy is performed. The heating temperature in the aggregation and fusion step (Step 3) and the heating temperature and time in the first aging step (Step 4) are controlled, so that the surfaces of the core particles, with a constant particle size and with a narrow particle size distribution, have a smooth and uniform shape. Specifically, in the aggregation and fusion step (Step 3), the heating temperature is set low to suppress the progress of fusion between the core binder resin fine particles and promote homogenization, while the heating temperature is set low and the heating time is set long in the first aging step to control the surfaces of the core particles to have a uniform shape.

(Step 5) Shell Layer Forming Step

In this step, a shell forming process is performed by adding the dispersion liquid of the shell binder resin fine particles to the dispersion liquid of the core particles to allow the shell binder resin fine particles to aggregate and fuse on the surface of the core particle to coat the surface of the core particle with the shell binder resin fine particles, thereby forming a particle having a core-shell structure.

This step is a preferable production condition for applying both performances of low-temperature fixability and heat-resistant storability. When a color image is to be formed, it is preferable to form this shell layer in order to obtain high color reproducibility for secondary colors.

Specifically, while the dispersion liquid of the core particles is kept at the heating temperature in the aggregation and fusion step (Step 3) and the first aging step (Step 4), the dispersion liquid of the shell binder resin fine particles is added. While heating and stirring are continued, the shell binder resin fine particles are allowed to coat the core particle surface slowly over a few hours to form a particle of the core-shell structure. The heating and stirring time is preferably 1 to 7 hours, particularly preferably 3 to 5 hours.

(Step 6) Second Aging Step

In this step, at the stage when the particle of core-shell structure attains a predetermined particle size through the shell layer forming step (Step 5), a stopping agent such as sodium chloride is added to stop particle growth and, in order to continuously fuse the shell binder resin fine particles attached to the core particle, heating and stirring are kept for a few hours. The thickness of the layer of the shell binder resin fine particles that coat the surface of the core particle is set to 100 to 300 nm. In this way, the shell binder resin fine particles adhere to the surface of the core particle to form a shell layer, thereby forming a toner particle having a round core-shell structure with a uniform shape.

(Step 7) Filtration and Washing Step

In this step, first, a process of cooling the dispersion liquid of the toner particles is performed. As a cooling process condition, the cooling rate may be 1 to 20° C./min. Examples of the cooling process method include, but not limited to, a cooling process by introducing a refrigerant from the outside of the reaction chamber and a cooling process by adding cold water directly into the reaction system.

Subsequently, toner particles are separated from the dispersion liquid of the toner particles cooled to a predetermined temperature. Subsequently, a washing process is performed by removing adherents such as the surfactant or the salting-out agent from the separated toner cake (an assembly formed by coagulating the wet toner particles into the form of a cake). Here, examples of the filtering process method include, but not limited to, centrifugal separation, reduced-pressure filtering using a Nutsche, and filtering using a filter press.

(Step 8) Drying Step

In this step, the washed toner cake is dried. Examples of the dryer for use in this step include spray dryers, vacuum freeze dryers, and reduced-pressure dryers. Preferably, a stationary shelf dryer, a movable shelf dryer, a fluidized bed dryer, a rotary dryer, a stirring-type dryer is used. The water content of the dried toner particles is preferably not more than 5% by mass, further preferably not more than 2% by mass.

When the dried toner particles aggregate with a weak inter-particle force, the aggregate may be disintegrated. For the disintegration process, a mechanical disintegrator such as a jet mill, a Henschel mixer, a coffee mill, or a food processor can be used.

(Step 9) External Additive Step

In this step, an external additive is added to the toner particles dried in the drying step (Step 8). An external additive is added using a mechanical mixing device, for example, a Henschel mixer or a coffee mill.

[7-10] Specific Examples of Production of Toner

Production Example (1) of Resin Dispersion Liquid

In a reaction chamber having an agitator, a thermometer, a cooling pipe, and a nitrogen gas introducing pipe, 85 parts by mass of terephthalic acid, 6 parts by mass of trimellitic acid, and 250 parts by mass of bisphenol A-propylene oxide adduct were put, and the reaction chamber was purged with dry nitrogen gas. Subsequently, 0.1 parts by mass of titanium tetrabutoxide was added and allowed an agitation reaction to proceed for eight hours at about 180° C. under a nitrogen gas flow. In addition, 0.2 parts by mass of titanium tetrabutoxide was added to allow an agitation reaction to proceed for six hours with the temperature increased to about 220° C. Subsequently, the reaction proceeded in the reaction chamber with a pressure reduced to 10 mmHg to yield a polyester resin [A1]. The polyester resin [A1] has a glass transition point (Tg) of 59° C. and a weight-average molecular weight (Mw) of 9,000.

In 200 parts by mass of ethyl acetate, 200 parts by mass of the amorphous polyester resin [A1] was dissolved. While the solution was stirred, an aqueous solution of sodium polyxyethylene laurylether sulfate dissolved in 800 parts by mass of ion exchange water at a concentration of 1% by mass was added dropwise slowly. After ethyl acetate was removed from this solution under a reduced pressure, the pH was adjusted to 8.5 with ammonia. Subsequently, the solid content concentration was adjusted to 20% by mass. Thus, a dispersion liquid of fine particles of the amorphous polyester resin [A1] was prepared, in which fine particles of the polyester resin [A1] were dispersed in the water-based medium.

Production Example (2) of Resin Dispersion Liquid

In a reaction chamber having an agitator, a thermometer, a cooling pipe, and a nitrogen gas introducing pipe, 315 parts by mass of dodecanedioic acid and 220 parts by mass of 1,6-hexanediol were put, and the reaction chamber was purged with dry nitrogen gas. Subsequently, 0.1 parts by mass of titanium tetrabutoxide was added to allow an agitation reaction to proceed for eight hours at about 180° C. under a nitrogen gas flow. In addition, 0.2 parts by mass of titanium tetrabutoxide was added to allow an agitation reaction to proceed for six hours with the temperature increased to about 220° C. Subsequently, a reaction proceeded in the reaction chamber with a pressure reduced to 10 mmHg to yield a polyester resin [B1]. The polyester resin [B1] has a melting point (Tm) of 72° C. and a weight-average molecular weight (Mw) of 14,000.

Preparation Example of Wax Dispersion Liquid 200 parts by mass of Fishcher-Tropsch Wax "FNP-0090" (manufactured by Nippon Seiro Co., Ltd., melting point 89° C.) was heated to 95° C. and melted. This was put into a surfactant aqueous solution of sodium alkyldiphenyletherdisulfonate dissolved in 800 parts by mass of ion exchange water at a concentration of 3% by mass and subjected to a dispersion process using an ultrasonic homogenizer. The solid content concentration was adjusted to 20% by mass. Thus, a wax dispersion liquid was prepared, in which fine particles of the wax were dispersed in the water-based medium.

Production Example of Toner (1)

Toner (1) described later was produced as follows.

Specifically, 300 parts by mass of the polyester resin [A1] dispersion liquid, 100 parts by mass of the polyester resin [B1] dispersion liquid, 77.3 parts by mass of the wax dispersion liquid, 41.3 parts by mass of a coloring agent dispersion liquid, 225 parts by mass of ion exchange water, and 2.5 parts by mass of sodium polyxyethylene laurylether sulfate were put into a reaction chamber having an agitator, a cooling pipe, and a thermometer. While the product was stirred, 0.1N-hydrochloric acid was added to adjust the pH to 2.5.

Subsequently, after 0.3 parts by mass of poly aluminium chloride aqueous solution (10% aqueous solution in terms of $AlCl_3$) was added dropwise over 10 minutes, the internal temperature was increased to 60° C. while the product was stirred. In addition, the temperature was gradually increased to 75° C., and with the internal temperature kept at 75° C., measurement was conducted with a Coulter counter. When the average particle size reached the order of 6 μm, 2 parts by mass of 3-hydroxy-2,2'-tetrasodium iminodisuccinate aqueous solution (40% aqueous solution) was added to stop the growth of particle size. The internal temperature was increased to 85° C., and at a point of time when the shape factor reached 0.96 according to "FPIA-2000", the product was cooled to room temperature at a rate of 10° C./min. This reaction liquid was repeatedly filtered and washed, and then dried to yield toner particles [1].

To the resultant toner particles [1], 1% by mass of hydrophobic silica (number-average primary particle size=12 nm, hydrophobicity=68) and 1% by mass of hydrophobic titanium oxide (number-average primary particle size=20 nm, hydrophobicity=63) were added and mixed with "Henschel mixer" (manufactured by Mitsui Miike Machinery Co., Ltd.). Subsequently, coarse particles were removed using a mesh with an opening of 45 μm to yield toner (1).

The volume median diameter of toner (1) is 6.10 μm, the average circularity is 0.965, and the storage elastic modulus G' (60) at a temperature of 60° C. is $5\times10^7$ Pa.

Production Example 3 of Toner (2)

Toner (2) described later was produced as follows.

Toner (2) was produced in the same manner as for toner (1) except that the parts by mass of the polyester resin [A1] dispersion liquid and the parts by mass of the polyester resin [B1] dispersion liquid in toner (1) were changed to "380 parts by mass of the polyester resin [A1] dispersion liquid" and "20 parts by mass of the polyester resin [B1] dispersion liquid", respectively.

The storage elastic modulus G' (60) of toner (2) at a temperature of 60° C. is $1.2\times10^7$ Pa.

[8] EXAMPLES

[8-1] Image Formation Under Various Conditions

FIG. 8 is a diagram showing the results of image formation under various conditions in MFP 500. FIG. 8 shows Example 1 to Example 12. In the image formation shown in FIG. 8, the conditions changed are paper types (the types of paper P), torque T1:T2 (the ratio between fixing-side torque T1 and pressing-side torque T2), T2 relative ratio (the ratio of pressing-side torque T2 relative to Example 1), belt hardness (hardness of fixing belt 605), toner/G' 60 (toner kind/storage elastic modulus at 60° C.), and NIP length (the length of the nip portion).

The paper types include "OK TOPCOAT" and "LEZAK 66/151 g". "OK TOPCOAT" is an example of smooth paper and indicates OK TOPCOAT (manufactured by OJI PAPER CO., LTD., 85 g/m$^2$, Bekk smoothness 1600 sec). "LEZAK 66/151 g" is an example of embossed paper and indicates LEZAK 66 (manufactured by OSTRICHDIA CO., LTD., 151 g/m$^2$, Bekk smoothness 2 sec).

As for torque T1:T2, for example, it is indicated that in Example 1, the ratio between fixing-side torque T1 and pressing-side torque T2 is "5:95".

As for T2 relative ratio, for example, in Example 2, a value "0.79" is shown. This indicates that the value of pressing-side torque T2 in Example 2 is 0.79 time the value of pressing-side torque T2 in Example 1.

In the fields of belt hardness, five kinds of belts (belts 1 to 5) different in hardness of fixing belt 605 are shown. The structure of each belt is shown below. "PI" represents polyimide. In each belt, a silicone rubber layer is formed on a polyimide base and has a surface coated with PFA.

Belt 1: base material PI, rubber layer 220 μm, rubber hardness 20°, PFA layer 30 μm, MD-1 hardness 85° (type C)

Belt 2: base material PI, rubber layer 300 μm, rubber hardness 20°, PFA layer 30 μm, MD-1 hardness 80° (type C)

Belt 3: base material PI, rubber layer 150 μm, rubber hardness 36°, PFA layer 30 μm, MD-1 hardness 95° (type C)

Belt 4: base material PI, rubber layer 120 μm, rubber hardness 36°, PFA layer 30 μm, MD-1 hardness 96° (type C)

Belt 5: base material PI, rubber layer 300 μm, rubber hardness 11°, PFA layer 30 μm, MD-1 hardness 79° (type C)

In the fields of toner/G' 60, two kinds of toner different in storage elastic modulus at 60° C. are shown. The respective storage elastic moduli of toner (1) and toner (2) at 60° C. are $5\times10^7$ Pa and $1.2\times10^8$ Pa.

In FIG. 8, two kinds of NIP length are shown. More specifically, the NIP length is "18 mm" in Example 1 to Example 11 and "24 mm" in Example 12.

The belt peripheral length is 120 mm.

In the example in FIG. 8, fixing roller 602 has a rubber thickness of 20 mm, a rubber hardness of 10 degrees, and a diameter of 60 mm. Pressing roller 609 has a rubber thickness of 5 mm, a rubber hardness of 10 degrees, and a diameter of 60 mm. The rubber of both rollers is silicone rubber, and the surfaces of both rollers are coated with PFA resin.

The setting temperature of heater 63 is 180° C., the load of the nip portion is 2000 N, and the paper passing speed is 300 mm/sec.

The amount of toner adhesion is 8 g/m$^2$.

FIG. 8 shows three kinds of evaluation methods, namely, "image disorder", "separation", and "fixing strength".

The "image disorder" is the evaluation result obtained by capturing a fixed image with a scanner and converting the result into a gray scale, which is then binarized to calculate the black-white ratio. The black-white ratio (BW ratio) of 99.9% or higher is denoted as "A", the ratio equal to or higher than 99.5% (lower than 99.9%) is denoted as "B", and the ratio equal to or higher than 99% (lower than 99.5%) is denoted as "C".

The "separation" indicates the evaluation result obtained when paper P having a white portion 5 mm from the front end and having a toner image at the back of the 5-mm front is passed through fixing unit 60. When paper P is separated from fixing unit 60 and discharged, the result is denoted as "B". When paper fails to be separated from fixing unit 60 and is caught by fixing roller 602 or the like, the result is denoted as "C".

The "fixing strength" indicates the evaluation result obtained when wood-free paper is put on a fixed image and rubbed ten times with a weight of 100 g/cm$^2$ put thereon. Wood-free paper is used as paper P. The evaluation result is derived based on a stain on the rubbed wood-free paper. The result with no stain on the wood-free paper is denoted as "B", and the result with a slight stain on the wood-free paper is denoted as "C".

[8-2] Discussion about Evaluation Result for Formed Image (Torque T1:T2)

As shown in FIG. 8, in all of Examples 1 to 12, pressing-side torque T2 is equal to or greater than fixing-side torque T1 (see the fields of torque T1:T2).

In both of Example 3 and Example 4, the paper type is changed when compared with Example 1. In Example 3, the smoothness of paper is reduced compared with Example 1 but the difference between fixing-side torque T1 and pressing-side torque T2 is the same as Example 1.

In Example 4, the smoothness of paper is reduced compared with Example 1, and in addition, the difference between fixing-side torque T1 and pressing-side torque T2 is smaller. When compared with Example 3, in Example 4, the result of "image disorder" is superior.

Based on this, it can be said that when the smoothness of paper is reduced, it is preferable to reduce the difference between fixing-side torque T1 and pressing-side torque T2.

(Belt Hardness)

In Example 6, Example 9, and Example 10, the conditions are common except for "belt hardness". In Example 6, "belt hardness" is in the range of 80° or more to 95° or less, whereas in Example 9 and Example 10, "belt hardness" is outside the range of 80° or more to 95° or less.

In the evaluation result for Example 6, "image disorder" is "A", and "separation" and "fixing strength" are "B". On the other hand, in the evaluation results for Example 9 and Example 10, the result in at least one of the items is inferior to the evaluation result for Example 6. More specifically, "image disorder" in Example 9 is "B". In Example 10, the "fixing strength" is "C".

Based on this, it can be said that the results in FIG. 8 support that it is preferable that the "belt hardness" is within a range of 80° or more to 95° or less.

(T2 Relative Ratio)

In Example 3 to Example 5, the conditions are common except for "torque T1:T2" and "T2 relative ratio". In Example 5, "T2 relative ratio" is not more than 0.9, whereas in Examples 3, 4, "T2 relative ratio" exceeds 0.9.

In the evaluation result for Example 5, "image disorder" is "A", and "separation" and "fixing strength" are "B". On the other hand, in the evaluation results for Example 9 and Example 10, the result of at least one of the items is inferior to the evaluation result for Example 5. More specifically, in the result of Example 9, "image disorder" is "B". In the result of Example 10, the "fixing strength" is "C".

The paper type (LEZAK 66) in Example 3 to Example 5 is different from the paper type (OK TOPCOAT) in Example 1. More specifically, the smoothness of paper (LEZAK 66: Bekk smoothness 2 sec) in Example 3 to Example 5 is lower than the smoothness of paper (OK TOPCOAT: Bekk smoothness 1600 sec) in Example 1. "T2 relative ratio" is the ratio of pressing-side torque T2 in each Example relative to pressing-side torque T2 in Example 1.

Based on these, the results in FIG. 8 support that it may be that the ratio of pressing-side torque T2 when the smoothness of paper is less than a predetermined value to pressing-side torque T2 when the smoothness of paper is equal to or greater than a predetermined value may be 0.9 or more.

As described with reference to formula (2) in FIG. 4, in pressing roller 906, tangential force F2 applied to the pressing roller 906-side surface of paper P is proportional to pressing-side torque T2. Therefore, it can be said that the results in FIG. 8 support that it may be that the ratio of tangential force F2 on the pressing roller side when the smoothness of paper is less than a predetermined value to tangential force F2 on the pressing roller side when the smoothness of paper is equal to or greater than a predetermined value is preferably 0.9 or more.

(NIP Length)

In Example 6 and Example 12, the conditions are matched except for the four conditions: paper type, NIP length, torque T1:T2, and T2 relative ratio. In Example 6, torque T1:T2 is 25:75, and the NIP length is 18 mm. In Example 12, torque T1:T2 is 49:51, the NIP length is 24 mm, and LEZAK 66/203 g (manufactured by OSTRICHDIA CO., LTD., 151 g/m$^2$, Bekk smoothness 2 sec) is used as paper P.

In Example 12, when compared with Example 6, while the NIP length is longer, the difference between pressing-side torque T2 and fixing-side torque T1 is smaller. By satisfying such conditions, Example 6 and Example 12 both exhibit a good evaluation result. That is, in both of the evaluation results of Example 6 and Example 12, "image disorder" is "A", and "separation" and "fixing strength" are "B".

Based on this, the results in FIG. 8 support that it may be that as the length of the nip portion increases, the difference between pressing-side torque T2 and fixing-side torque T1 decreases.

As described with reference to formula (1) and formula (2) in FIG. 4, in paper P, tangential force F1 is proportional to pressing-side torque T1, and tangential force F2 is proportional to pressing-side torque T2. Therefore, the results in FIG. 8 support that it may be that as the length of the nip portion increases, the difference between tangential force F2 on the pressing roller 609 side and tangential force F1 on the fixing roller 602 side decreases.

According to the present disclosure, the fixing device or the image processing apparatus applies a force equal to or greater than the force on the surface with an image formed thereon, to paper on the back surface of the surface with an image formed thereon, at the nip portion. This configuration produces an adequate shear force on the surface of paper with an image formed thereon.

The fixing device or the image processing apparatus adjusts the relation of tangential forces applied to the surface with an image formed thereon and the back surface thereof, in accordance with the smoothness of the surface of paper. With this configuration, a shear force suitable for the degree of protrusions and depressions (smoothness) in the surface of paper can be applied to paint such as toner for forming an image on paper.

Accordingly, disorder of an image formed on paper can be reduced irrespective of the smoothness of the surface of paper.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A fixing device comprising:

a fixing member configured to abut on a surface of paper, the surface having an image formed thereon;

a pressing member configured to hold paper in cooperation with the fixing member;

a fixing motor configured to drive the fixing member in order to convey paper held between the fixing member and the pressing member;

a pressing motor configured to drive the pressing member in order to convey paper held between the fixing member and the pressing member; and a control unit configured to control torques of the fixing motor and the pressing motor, the control unit being configured to acquire smoothness of paper held between the fixing member and the pressing member, control torques of the fixing motor and the pressing motor such that tangential force at a part holding paper in cooperation with the fixing member in the pressing member is equal to or greater than tangential force at a part holding paper in cooperation with the pressing member in the fixing member, and that a relation between the tangential force at the part of the pressing member and the tangential force at the part of the fixing member changes in accordance with the smoothness, and control torques of the fixing motor and the pressing motor such that a ratio of tangential force at the part of the pressing member when the smoothness is less than a predetermined value to tangential force at the part of the pressing member when the smoothness is equal to or greater than the predetermined value is 0.9 or less.

2. The fixing device according to claim 1, wherein the control unit is configured to control torques of the fixing motor and the pressing motor such that a difference between tangential force at the part of the pressing member and tangential force at the part of the fixing member increases as the smoothness increases.

3. The fixing device according to claim 1, further comprising a fixing roller and a heating roller configured to rotate the fixing member, wherein the fixing member includes a belt stretched around the fixing roller and the heating roller.

4. The fixing device according to claim 3, wherein a surface of the belt has MD-1 hardness (type C) of not less than 80° and not more than 95°.

5. The fixing device according to claim 1, further comprising a smoothness sensor configured to detect smoothness of paper, wherein the control unit is configured to acquire smoothness detected by the smoothness sensor.

6. The fixing device according to claim 1, further comprising a change unit configured to change a length of a part where the fixing member and the pressing member hold paper, in a paper conveyance direction, wherein the control unit is configured to control torques of the fixing motor and the pressing motor such that a difference between tangential force at the part of the pressing member and tangential force at the part of the fixing member decreases as the length of the part increases.

7. The fixing device according to claim 1, further comprising:

a fixing-side torque sensor configured to detect torque of the fixing motor; and a pressing-side torque sensor configured to detect torque of the pressing motor, wherein the control unit is configured to perform feedback control of torques of the fixing motor and the pressing motor, based on detection outputs of the fixing-side torque sensor and the pressing-side torque sensor.

8. An image forming apparatus comprising:

an image forming unit configured to form an image on paper; and a fixing unit configured to fix an image formed by the image forming unit on the paper, the fixing unit including a fixing member configured to abut on a surface of paper, the surface having an image formed thereon, a pressing member configured to hold paper in cooperation with the fixing member, a fixing motor configured to drive the fixing member in order to convey paper held between the fixing member and the pressing member, a pressing motor configured to drive the pressing member in order to convey paper held between the fixing member and the pressing member, and a control unit configured to control torques of the fixing motor and the pressing motor, the control unit being configured to acquire smoothness of paper held between the fixing member and the pressing member, control torques of the fixing motor and the pressing motor such that tangential force at a part holding paper in cooperation with the fixing member in the pressing member is equal to or greater than tangential force at a part holding paper in cooperation with the pressing member in the fixing member, and that a relation between the tangential force at the part of the pressing member and the tangential force at the part of the fixing member changes in accordance with the smoothness, and control torques of the fixing motor and the pressing motor such that a ratio of tangential force at the part of the pressing member when the smoothness is less than a predetermined value to tangential force at the part of the pressing member when the smoothness is equal to or greater than the predetermined value is 0.9 or less.

9. The image forming apparatus according to claim 8, wherein the control unit is configured to control torques of the fixing motor and the pressing motor such that a difference between tangential force at the part of the pressing member and tangential force at the part of the fixing member increases as the smoothness increases.

10. The image forming apparatus according to claim 8, further comprising a fixing roller and a heating roller configured to rotate the fixing member, wherein the fixing member includes a belt stretched around the fixing roller and the heating roller.

11. The image forming apparatus according to claim 10, wherein a surface of the belt has MD-1 hardness (type C) of not less than 80° and not more than 95°.

12. The image forming apparatus according to claim 8, further comprising a smoothness sensor configured to detect smoothness of paper, wherein the control unit is configured to acquire smoothness detected by the smoothness sensor.

13. The image forming apparatus according to claim 8, further comprising a change unit configured to change a length of a part where the fixing member and the pressing member hold paper, in a paper conveyance direction, wherein the control unit is configured to control torques of the fixing motor and the pressing motor such that a difference between tangential force at the part of the pressing member and tangential force at the part of the fixing member decreases as the length of the part increases.

14. The image forming apparatus according to claim 8, further comprising:

a fixing-side torque sensor configured to detect torque of the fixing motor; and a pressing-side torque sensor configured to detect torque of the pressing motor, wherein the control unit is configured to perform feedback control of torques of the fixing motor and the pressing motor, based on detection outputs of the fixing-side torque sensor and the pressing-side torque sensor.

15. A method of controlling an image forming apparatus, comprising the steps of:

forming an image on paper;

acquiring smoothness of the paper;

fixing the image on the paper by holding the paper between a fixing member and a pressing member;

controlling torque of a fixing motor configured to drive the fixing member and torque of a pressing motor configured to drive the pressing member in order to convey the paper held between the fixing member and the pressing member, wherein the fixing member abuts on a surface of the paper, the surface having an image formed thereon, tangential force at a part holding paper in cooperation with the fixing member in the pressing member is equal to or greater than tangential force at a part holding paper in cooperation with the pressing member in the fixing member, and a relation between the tangential force at the part of the pressing member and the tangential force at the part of the fixing member changes in accordance with the smoothness, and controlling torques of the fixing motor and the pressing motor such that a ratio of tangential force at the part of the pressing member when the smoothness is less than a predetermined value to tangential force at the part of the pressing member when the smoothness is equal to or greater than the predetermined value is 0.9 or less.

16. The method of controlling an image forming apparatus according to claim 15, wherein the step of forming an image includes forming an image using toner having an elastic modulus at 60° C. of $1\times10^{8}$ Pa or less.

* * * * *